US006495241B2

(12) United States Patent
Sato et al.

(10) Patent No.: US 6,495,241 B2
(45) **Date of Patent: *Dec. 17, 2002**

(54) IMAGE-TRANSFER MEDIUM FOR INK-JET PRINTING, TRANSFER PRINTING PROCESS USING THE SAME, AND TRANSFER PRINTING CLOTH

(75) Inventors: Yuko Sato, Kawasaki (JP); Mamoru Sakaki, Yamato (JP); Masato Katayama, Yokohama (JP); Masahiko Higuma, Togane (JP); Mifune Kudo, Kawasaki (JP); Kenichi Moriya, Urayasu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/845,439

(22) Filed: Apr. 25, 1997

(65) Prior Publication Data

US 2002/0054992 A1 May 9, 2002

(30) Foreign Application Priority Data

Apr. 30, 1996 (JP) ..... 8-130571
Aug. 6, 1996 (JP) ..... 8-221883

(51) Int. Cl.[7] ..... B41M 5/00

(52) U.S. Cl. ..... 428/195; 428/196; 428/326; 428/327; 156/230

(58) Field of Search ..... 428/195, 196, 428/206, 207, 212, 317.9, 323, 326, 327, 334, 475.5, 913, 914; 156/230, 246, 277

(56) References Cited

U.S. PATENT DOCUMENTS

| | | | | | |
|---|---|---|---|---|---|
| 4,785,313 | A | | 11/1988 | Higuma et al. | 346/135.1 |
| 5,418,078 | A | * | 5/1995 | Desie et al. | 428/704 |
| 5,501,902 | A | | 3/1996 | Kronzer | 428/323 |
| 5,601,928 | A | | 2/1997 | Katayama et al. | 428/500 |
| 5,798,179 | A | * | 8/1998 | Kronzer | 428/411.1 |
| 6,017,611 | A | * | 1/2000 | Cheng et al. | 428/195 |
| 6,139,672 | A | * | 10/2000 | Sato et al. | 156/235 |

FOREIGN PATENT DOCUMENTS

| | | |
|---|---|---|
| EP | 0227245 A2 | 7/1987 |
| GB | 2143180 A | 2/1985 |
| JP | 58-215392 | 12/1983 |
| JP | 58-222878 | 12/1983 |
| JP | 61-118293 | 6/1986 |
| JP | 62-140879 | 6/1987 |
| JP | 62-170383 | 7/1987 |
| JP | 2-295787 | 12/1990 |
| JP | 8-207450 | 8/1996 |

* cited by examiner

*Primary Examiner*—Marie Yamnitzky
(74) *Attorney, Agent, or Firm*—Fitzpatrick, Cella, Harper & Scinto

(57) ABSTRACT

An image-transfer medium for ink-jet printing, comprising a releasing layer and a transfer layer containing fine particles of a thermoplastic resin and a polymeric binder, provided on a base material, wherein the polymeric binder is a thermoplastic resin.

15 Claims, 3 Drawing Sheets

IMAGE-TRANSFER MEDIUM FOR INK-JET PRINTING, TRANSFER PRINTING PROCESS USING THE SAME, AND TRANSFER PRINTING CLOTH

BACKGROUND OF THE INVENTION

1. Field of the Invention

The present invention relates to a transfer medium suitable for use in forming an image on a printing medium by transfer printing, a transfer printing process using this image-transfer medium and a transfer printing cloth, and more particularly to an image-transfer medium for ink-jet printing in which an ink-jet printing system is used upon forming an ink image on a transfer layer thereof, a transfer printing process in which such an image-transfer medium is used to transfer the image formed on a transfer layer to a portion of a cloth, thereby forming an image on the cloth, and a cloth having the transferred image formed by the transfer printing process.

2. Related Background Art

An ink-jet printing method is a printing method in which printing is conducted by generating and ejecting droplets of an ink by one of various ink ejection systems, for example, an electrostatic attraction system, a system in which a piezoelectric element is used to give an ink mechanical vibration or change, or a system in which an ink is heated to form bubbles in the ink, thereby using the pressure thus produced, and applying the droplets in whole or in part to a printing medium. The ink-jet printing method attracts attention as a printing system which scarcely produces noise and can conduct high-speed printing and color printing.

In recent years, ink-jet printers, by which color printing can be simply conducted as described above, have been spread, and there has thus been an increasing demand for conducting color printing on various media, particularly, cloth, using these printers. In particular, a printing method using an image-transfer medium is very effective in that printing can be conducted irrespective of the forms of printing media, namely, the formation of an image can be performed on any medium which cannot be directly printed by a printer, so that it is possible to conduct printing on a cloth after subjecting to sewing or a large-sized cloth.

As processes in which an image-transfer medium making good use of an ink-jet technique is used, Japanese Patent Application Laid-Open Nos. 58-215392 and 58-222878 have proposed processes for printing an image on a transparent film. The former process is a heat transfer printing process in which an image is formed on a colorless transparent base paper sheet coated with a coating agent, and a transparent film is then laminated on the paper sheet to heat-transfer the image to the film. Accordingly, this process is a process of transferring the image by heat-fusing the film which is a transfer-printing medium. Therefore, this process cannot be applied to transfer-printing media having no heat fusibility. Japanese Patent Application Laid-Open No. 2-295787 has proposed a process in which a swelling layer is provided on a base material, an image is formed on this swelling layer, and the image is transferred to a cloth by heating it from the side of the base material, and a transfer-printing medium used in this process. However, dyes usable in the formation of the image in this proposal are sublimate dyes, so that it cannot be applied if an image-transfer medium is formed of natural fiber such as cotton. Japanese Patent Application Laid-Open No. 62-140879 discloses an image forming process in which an image is formed on a transfer-printing medium having a surface layer having high liquid permeability and fusibility and an ink-retaining layer, and the surface layer of the transfer medium is brought into contact with a medium to be transferred, thereby fuse-bonding the surface layer, and a printing medium. According to this process, it is possible to transfer the image to cloth, but the process involves a problem that since the image is formed on the ink-retaining layer composed mainly of a water-soluble polymer, the transferred image transferred to the cloth is poor in resistance to water and the like.

Japanese Patent Application Laid-Open No. 62-170383 has proposed a printing medium of constitution similar to the present invention though its object is different from that of the present invention. This printing medium comprises a base material and an ink-absorbing layer composed of fine particles of a thermoplastic resin and a polymeric binder provided on the base material. The thermoplastic fine particles are heated into a transparent film after printing, thereby providing a print having high weather resistance. However, if this printing medium is used as an intermediate transfer medium for cloth, it is difficult to transfer the ink-absorbing layer to the cloth even if heated because adhesion between the ink-absorbing layer and the base material is high, whereby a good image cannot be provided.

With respect to the transfer-printing media making good use of an ink-jet technique for forming an image on cloth, there are various problems to be solved as described above. In particular, the following requirements may be mentioned.

(1) Quality of Image Printed by an Ink-jet System:

First, in order to provide a clear transfer image having high color depth on a printing medium such as cloth, it is necessary to keep an image on an image-transfer medium high quality. Accordingly, image-transfer media for ink-jet printing are required to have such performance characteristics that they can receive inks quickly, that they have high ink absorbing capacity, that the diameters of ink dots formed thereon do not more increase than they need, that they can provide ink dots high in optical density and clear in periphery, and that they can provide ink dots having a substantially round shape and a smooth periphery.

(2) Transferability to Cloth:

In order to provide an image having high color depth after transfer, it is necessary for an image formed on a transfer medium to be efficiently transferred to cloth. Accordingly, image-transfer media for ink-jet printing are required to have good transferability to the cloth and further to permit the formation of an image-forming layer (transfer layer) adapted to cloth because the cloth generally has considerably high stretch properties.

(3) Fastness Properties after Transferred to Cloth:

Performance characteristics required of an image formed on cloth after transfer include fastness properties such as fastness to laundering and fastness to perspiration. In particular, when an image is formed by means of a general-purpose ink-jet printer, it is impossible to select optimum coloring materials for individual fibers among various kinds of fibers. Accordingly, in order to permit a wide variety of formation of images for various kinds of fibers, the image-transfer media for ink-jet printing are required to cause coloring materials to strongly fix to cloth so as to prevent the coloring materials from bleed when a transferred image is wetted with water or perspiration even when the coloring materials have no dyeing property to fiber of the cloth in themselves.

SUMMARY OF THE INVENTION

It is therefore an object of the present invention to provide an image-transfer medium making good use of an ink-jet printing technique, which permits the formation of a satisfactory image on cloth, a transfer printing process using this medium and a transfer-printing cloth having an image formed by the transfer printing process, and particularly to provide an image-transfer medium for ink-jet printing, which satisfies the following requirements:

(1) having a transfer layer high in ink absorbency;

(2) permitting the formation of a clear transferred image having high color depth on cloth;

(3) having a transfer layer high in adhesion to cloth and providing a transferred image having good transferability; and (4) having a transfer layer which exhibits high fastness properties after transferred to cloth.

Another object of the present invention is to provide an image-transfer medium for ink-jet printing, which satisfies the above-described requirements (1) to (4) and permits the simple formation of images on cloth even in homes by means of a general-purpose ink-jet printer, and a transfer-printing process using this medium.

The above objects can be achieved by the present invention described below.

According to the present invention, there is thus provided an image-transfer medium for ink-jet printing, comprising a releasing layer and a transfer layer containing fine particles of a thermoplastic resins and a polymeric binder, provided on a base material, wherein the polymeric binder is a thermoplastic resin.

According to the present invention, there is also provided a transfer printing process comprising ejecting inks on a transfer layer of an image-transfer medium for ink-jet printing, which has the transfer layer provided on a base material, in accordance with an ink-jet printing method to form an image, placing cloth on the image-transfer medium from the side of the transfer layer on which the image has been formed, and heating and pressing the transfer layer from the side of the cloth or the base material to transfer the transfer layer to the cloth, thereby forming an image on the cloth, wherein the image-transfer medium for ink-jet printing is the image-transfer medium for ink-jet printing described above.

According to the present invention, there is further provided a transfer-printing cloth having a transfer image formed by the transfer printing process described above.

DETAILED DESCRIPTION OF THE PREFERRED EMBODIMENTS

Figure 1:
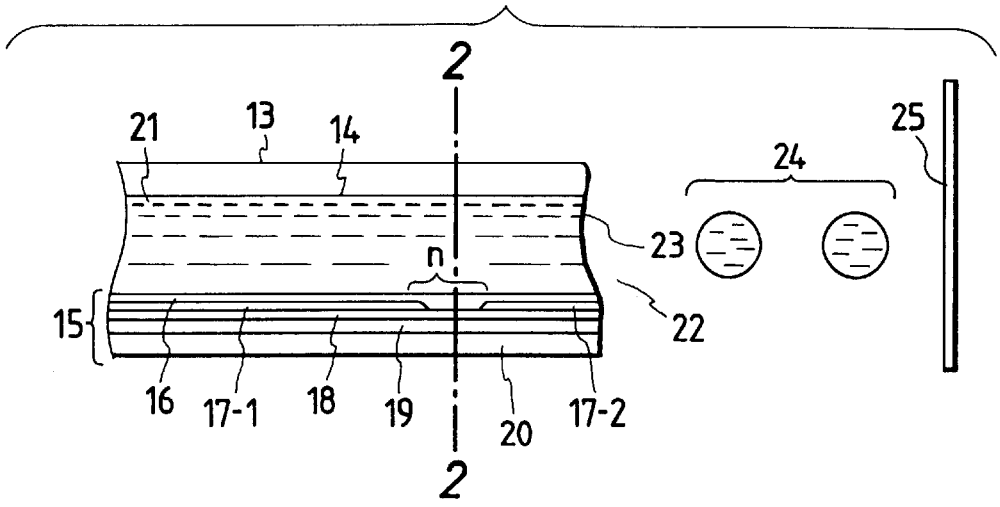
FIG. 1 is a longitudinal cross-sectional view of a head of an ink-jet printing apparatus.

The present invention will hereinafter be described in detail by preferred embodiments of the invention. The action of the present invention will be now described.

The image-transfer medium for ink-jet printing according to the present invention includes a releasing layer and a transfer layer provided on a base material. In order to form an image on cloth using the image-transfer medium, an image is first formed on the transfer layer in accordance with an ink-jet printing method, thereby retaining coloring materials in inks in the transfer layer. The transfer layer in which the coloring materials have been retained is then brought into contact with the cloth in such a manner that the image-transfer medium overlaps the cloth. The image-transfer layer is further heated and pressed from the side of the cloth or the base material to transfer the transfer layer to the cloth, thereby forming a transferred image on the cloth. Namely, the image-transfer medium for ink-jet printing according to the present invention is used as an intermediate transfer medium upon forming the image on the cloth using the ink-jet printing method. Therefore, the transfer layer making up the image-transfer medium for ink-jet printing according to the present invention is required to have in combination, first, a function of absorbing inks for ink-jet printing to form a high-quality image and retaining the image, second, a function of adhering to cloth to permit the transfer of the transfer layer to the cloth, and third, a function of fixing strongly coloring materials present in the transfer layer to the cloth after transferred to the cloth.

In the present invention, an image-transfer medium for ink-jet printing having the above-described constitution is provided, thereby obtaining a transfer layer satisfying all these functions. More specifically, in the present invention, fine particles of a thermoplastic resin and a thermoplastic resin as a polymeric binder are used as basic components for the transfer layer of the image-transfer medium for ink-jet printing. The term "fine particles of the thermoplastic resin" as used in the present invention mean fine particles formed of a water-insoluble thermoplastic resin. The fine particles of this thermoplastic resin form a transfer layer leaving the shape as the fine particles as they are, without forming a film before forming a transferred image, whereby voids defined by a large number of the fine particles of the thermoplastic resin are surely retained in the transfer layer. As a result, the transfer layer of the image-transfer medium according to the present invention retains high ink absorbing capacity, so that it is possible to form a high-quality image on the transfer layer by an ink-jet printing method.

When the image-transfer medium is laid to overlap a cloth in such a manner that the transfer layer comes into contact with the cloth after forming the image on the transfer layer containing the fine particles of the thermoplastic resin, and they are heated and pressed, the fine particles of the thermoplastic resin in the transfer layer are melted and bonded to the cloth, whereby the transfer layer is transferred to the cloth, and the fine particles of the thermoplastic resin is formed into a film. As a result, it is possible to strongly fix coloring materials in inks to the cloth. Further, when the transfer layer is transferred to the cloth, the fine particles of the thermoplastic resin in the transfer layer penetrate into fiber in a state that the fiber is surrounded by the fine particles. Therefore, the transferred image becomes beautiful without exposing the color of the underlying fiber even when the cloth is stretched after the transfer.

In the image-transfer medium for ink-jet printing according to the present invention, a water-soluble thermoplastic resin (hereinafter merely referred to as the water-soluble resin) is used as the polymeric binder which is a component for the transfer layer, whereby a transfer layer having higher strength can be formed while retaining the high ink absorbency achieved by the above-described fine particles of the thermoplastic resin. At the same time, the use of the water-soluble resin makes the coloring ability of water-based ink-jet printing inks in the transfer layer higher, so that a clearer image can be formed.

In the present invention, it is possible to impart water resistance to the water-soluble resin by containing a crosslinking agent together with the water-soluble resin into the transfer layer, thereby forming a transferred image having excellent fastness properties. In this case, it is not always necessary to crosslink the water-soluble resin before forming the image by the ink-jet printing method. Alternatively, the water-soluble resin may be partially crosslinked within limits not impairing the ink absorbency and thermoplasticity of the water-soluble resin. In particular, when a water-soluble resin having high film-forming property and excellent function as a binder is used, it is not necessary to conduct crosslinking before the formation of an image. When a water-soluble resin having low film-forming property is used, however, it is preferable to use the water-soluble resin in a state that it is partially crosslinked within limits not impairing the ink absorbency and thermoplasticity thereof in order to enhance the film strength of the transfer layer. In any case, the transfer layer permits the formation of a high-quality and clear image while retaining high ink absorbency before transfer thereof. On the other hand, when the transfer layer is pressed and heated to form a transfer image on cloth, the crosslinking agent acts on the water-soluble resin in the transfer layer to impart water resistance to the water-soluble resin, and at the same time also on the cloth, thereby permitting the formation of a transferred image having high fastness properties.

In the image-transfer medium for ink-jet printing according to another embodiment of the present invention, when a water-insoluble thermoplastic resin (hereinafter merely referred to as the water-insoluble resin) is used as the polymeric binder which is a component for the transfer layer, the water-insoluble resin is melted and bonded to cloth together with the fine particles of the thermoplastic resin upon transferring the transfer layer to the cloth by heating and pressing, whereby the transfer layer is transferred, and the water-insoluble resin is formed into a film on the cloth. As a result, it is possible to strongly fix coloring materials in inks to the cloth. Described specifically, the water-insoluble resin has a low solubility in water, and so when the transfer layer is wetted with water after transferred on the cloth, the resin is not dissolved in water, thereby permitting the formation of a transferred image having excellent fastness properties without causing disorder of the image.

In the image-transfer medium for ink-jet printing according to a further embodiment of the present invention, when finely particulate cellulose is contained as a further component in a transfer layer composed of such components as described above, the surface of a transferred image formed on cloth is prevented from shining clearly with gloss in addition to the various excellent effects described above, thereby permitting the provision of a cloth having a high-quality image wherein there is no difference in hand between a non-image formed portion and an image formed portion of the cloth.

The image-transfer media for ink-jet printing according to the present invention have a releasing layer together with the transfer layer of such a constitution as described above. The presence of the releasing layer allows the transfer layer having the excellent properties described above to efficiently and easily transfer to a printing medium such as cloth. Described specifically, when the releasing layer is provided on the image-transfer medium for ink-jet printing, the release property of the transfer layer to the base material making up the image-transfer medium is made good. For example, the base material is removed from the cloth after transferred to the cloth, the fact that the transfer layer on the cloth is separated together, or that a part of the transfer layer remains on the base material without being transferred, so that the disorder of the image is effectively prevented.

The components making up the image-transfer media for ink-jet printing according to the present invention will hereinafter be described.

As the fine particles of the thermoplastic resin used in forming the transfer layer of the image-transfer media for ink-jet printing according to the present invention, any fine particles may be used so far as they are fine particles formed of a water-insoluble thermoplastic resin. Examples of such a thermoplastic resin include polyethylene, polypropylene, polyvinyl acetate, polyvinyl acetal, polymethacrylates, polyacrylates, polyether, polyester, polycarbonate, cellulosic resins, polyacrylonitrile, nylon, polyimide, polyamide, polyvinyl chloride, polyvinylidene chloride, polystyrene, thiokol, polysulfone, polyurethane and copolymer of these resins. Among others, fine particles separately formed of polyethylene, polypropylene, polyvinyl acetate, polyvinyl chloride, nylon and polyurethane are more preferably used. Fine particles formed of a mixture of two or more of these resin materials, or a mixture of two or more of the fine particles separately formed of these resin materials may also be used.

The particle diameter of the fine particles of the thermoplastic resin used in the present invention is preferably within a range of from 0.05 to 100 $\mu$m, more preferably from 0.2 to 50 $\mu$m, most preferably from 5 to 20 $\mu$m from the viewpoints of the ink absorbency of the resulting transfer layer and the clearness of the resulted image. If the particle diameter is smaller than 0.05 $\mu$m, interparticle voids become too small, resulting in a transfer layer insufficient in ink absorbency. Further, if the particles are too small, the smoothness of the surface of the resulting transfer layer becomes high, so that the fine particles become hard to penetrate into the fibers of cloth, and a transferred image transferred to the cloth tends to be formed as an even continuous film on the surface of the cloth. As a result, such problems that the transferred image becomes easy to be separated, and the transfer layer cracks to expose the underlying fiber when the cloth is stretched arise. On the other hand, if the particle diameter of the fine particles of the thermoplastic resin is greater than 100 $\mu$m, the resolution of the resulting image becomes low, so that it is difficult to provide a clear image. Incidentally, when two or more kinds of fine particles are used in combination, those having the same particle diameter, or those different in particle diameter may be used in combination.

As the material for the fine particles of the thermoplastic resin used in the present invention, it is preferable to use a water-insoluble thermoplastic resin capable of being sufficiently melted by a household iron or the like so as to be able to simply transfer an image formed on the transfer layer of the image-transfer medium for ink-jet printing according to the present invention by means of a general-purpose ink-jet printer to cloth in a home or the like, thereby forming a transferred image. Taking this regard into consideration, a resin having a melting point ranging from 70 to 200° C., preferably from 80 to 180° C., more preferably from 100 to 160° C. is used as the material for the fine particles of the thermoplastic resin. Namely, when a material for the fine particles of the thermoplastic resin having a melting point lower than 70° C. is used, the fine particles of the thermoplastic resin in the transfer layer form a continuous film according to conditions where the resulting image-transfer medium is shipped or stored, so that there is a possibility that the ink absorbency of the transfer layer may be deteriorated, and its function may be impaired. In the present invention, it is necessary for the fine particles of the thermoplastic resin to exist in the transfer layer of the image-transfer medium for ink-jet printing leaving the shape as the fine particles as they are, before forming a transferred image. After coating the base material with the fine particles of the thermoplastic resin upon the production of the image-transfer medium for ink-jet printing according to the present invention, it is therefore necessary to dry the coating film formed of the fine particles of the thermoplastic resin at a temperature lower than the melting point of the thermoplastic resin. It is thus preferable to use the material for the fine particles of the thermoplastic resin having a melting point of at least 70° C. for the purpose of facilitating the drying from the viewpoint of production efficiency. On the other hand, if a material for the fine particles of the thermoplastic resin having a melting point higher than 200° C. is used, higher energy is required for transferring the resulting image to cloth. It is hence difficult to simply form a transferred image on cloth by a household iron or the like, which is an object of the present invention.

Taking the adhesion of the transferred image to the cloth after the transfer into consideration, it is preferable to use a material for the fine particles of the thermoplastic resin having a low melt viscosity. More specifically, when the melt viscosity of the resulting fine particles of the thermoplastic resin is high, the adhesion of the transfer layer to the cloth becomes poor, so that the transfer layer in the form of a continuous film is easy to be separated. However, when the material having a low melt viscosity is used, the fine particles of the thermoplastic resin in the transfer layer become easy to penetrate into fibers upon transfer, thereby providing a good transferred image wherein the color of the underlying fiber is not exposed even when the cloth is stretched after the transfer.

In order not to impair hand of the cloth as much as possible after the formation of the transferred image, it is preferable to use a water-insoluble resin, which can give a film having high flexibility upon the formation of a film by heating and pressing, as a material for the fine particles of the thermoplastic resin.

The polymeric binder, which is another component used in forming the transfer layer of the image-transfer medium for ink-jet printing according to the present invention, will now be described. In the present invention, a thermoplastic resin is used as the polymeric binder. The term "thermoplastic resin" as used herein means a resin (generally, a linear polymeric compound) which becomes soft and exhibites a flowability by heating, and also it includes, in addition to the above, a three-dimensional cross-linked resin so far as it more or less exhibits a flexibility or a stickiness by heating. As described above, the use of a water-soluble thermoplastic resin (water-soluble resin) as the polymeric binder brings about an effect of enhancing the coloring ability of coloring materials while retaining the good ink absorbency of the transfer layer achieved by the fine particles of the thermoplastic resin. On the other hand, the use of a water-insoluble thermoplastic resin (water-insoluble resin) as the polymeric binder brings about an excellent effect for enhancing the water fastness of the transferred image formed on cloth due to its low solubility in water.

Any conventionally-known material may be employed as a water-soluble resin used as the polymeric binder in the present invention so far as it has good ink absorbency and does not adversely affect the coloring of coloring materials in inks. Specific examples thereof include synthetic polymers such as polyvinyl alcohol, polyethylene glycol, polypropylene glycol, polyacrylamide, polyacrylic acid, polyvinyl pyrrolidone, water-soluble alkyd resins, polyvinyl ether, maleic acid copolymers, polyethyleneimine and water-soluble polyurethane; semisynthetic polymers, such as cellulosics such as viscose, methyl cellulose, ethyl cellulose, carboxymethyl cellulose and hydroxyethyl cellulose, and starch derivatives such as soluble starch, carboxyl starch, British gum, dialdehyde starch, dextrin and cationic starch; and natural polymers, such as starch such as corn starch, wheat starch, potato starch, marine algae such as glue plant, agar and sodium alginate, plant mucilages such as gum arabic, tragacanth gum, hibiscus and konjak, animal proteins such as glue, casein, gelatin, egg albumen and plasma proteins, and fermentation mucilages such as pullulan and dextran. Of these, partially saponified polyvinyl alcohol having a saponification degree of 75 to 95%, and cellulosics such as polyhydroxyethyl cellulose are preferably used in the present invention because a transfer layer having high ink absorbency and capable of enhancing the coloring ability of coloring materials can be provided.

With respect to the composition of the materials making up the transfer layer of the image-transfer medium for ink-jet printing according to the present invention, when such a water-soluble resin as described above is used as the polymeric binder, a mixing ratio by weight of the fine particles of the thermoplastic resin to the water-soluble resin is preferably within a range of from 1:5 to 50:1, more preferably from 1:5 to 20:1, most preferably 1:2 to 15:1. If the amount of the water-soluble resin exceeds 1:5, the proportion of the water-soluble resin in the resulting transfer layer becomes too high, so that the fastness properties, such as fastness to laundering and fastness to perspiration, of the transferred image transferred are deteriorated. On the other hand, if the amount of the water-soluble resin, or the polymeric binder, is less than 50:1, adhesion among the fine particles of the thermoplastic resin or between the fine particles and the releasing layer becomes insufficient, so that it is difficult to form a transfer layer having sufficient strength on the base material.

When such a water-soluble resin as described above is used as the polymeric binder in the present invention, water resistance can be imparted to the water-soluble resin by containing a crosslinking agent in the transfer layer, so that it is possible to form a clear transferred image improved in fastness properties and having high color depth.

The crosslinking agent to be contained in the transfer layer may be added either in the form that it does not act on the water-soluble resin before transferring the image formed, or in the form that it partially acts on the water-soluble resin within limits not impairing the ink absorbency and thermoplasticity of the water-soluble resin. As described above, when a water-soluble resin having a high film-forming property and excellent function as a binder is used, it is not necessary to conduct crosslinking before the formation of an image. When a water-soluble resin having low film-forming property is used, however, it is preferable to use the water-soluble resin in a state that it is partially crosslinked within limits not impairing the ink absorbency and thermoplasticity thereof in order to enhance the film strength of the transfer layer. In any case, the use of the water-soluble resin having high ink absorbency as the polymeric binder can provide a transfer layer which permits the formation of a high-strength and clear image having high color depth due to the presence of the water-soluble resin while retaining a high ink absorbency achieved by the fine particles of the thermoplastic resin in the transfer layer in a stage that ink-jet printing is conducted. On the other hand, when the transfer layer is transferred to cloth by a heating and pressing treatment, the water-soluble resin and the crosslinking agent in the transfer layer acts on each other to impart water resistance to the water-soluble resin. As a result, a transferred image improved in fastness properties can be provided.

No particular limitation is imposed on the crosslinking agent having such effects as described above used in the present invention so far as it has a function of blockading hydrophilic groups in the water-soluble resin or converting such groups into hydrophobic groups, and any crosslinking agent may be used. Specific examples of the crosslinking agent include N-methylol compounds, activated vinyl compounds, amino resins, halogen compounds, isocyanates, epoxy compounds, bifunctional acid anhydrides, aldehydes, metal alkoxides and organic acid metal salts.

As a method of preventing the crosslinking agent in the transfer layer from acting on the water-soluble resin before the formation of an image, it is preferable to prepare the transfer layer of the image-transfer medium for ink-jet printing according to the present invention at a temperature and a pressure at which the crosslinking agent composed of such a material as described above does not act on the water-soluble resin. Besides, it is an effective means to use a crosslinking agent encapsulated in microcapsules or a crosslinking agent in which its active reactive group has been masked to be blocked, so that the crosslinking agent may be retained in the transfer layer in a state got out of its contact with the water-soluble resin until a predetermined amount of heat and/or pressure is applied to the crosslinking agent.

According to the image-transfer medium for ink-jet printing according to the present invention, a good image is formed on the transfer layer by an ink-jet printing method due to the constitution as described above. Thereafter, the transfer layer is brought into contact with cloth, and heated and pressed to transfer the transfer layer to the cloth. As a result, the crosslinking agent is acted on the water-soluble resin by heat and/or pressure, thereby imparting a water resistance to the water-soluble resin, and at the same time also acted on the cloth, which is a transfer-printing medium, thereby permitting the formation of a transferred image having excellent fastness properties on the cloth after the transfer. In the present invention, the content of such a crosslinking agent as described above in the transfer layer may be a necessary amount to blockade the hydrophilic groups in the water-soluble resin or convert them into hydrophobic groups and varies according to the kinds of the water-soluble resin and crosslinking agent used. Incidentally, in order to facilitate the crosslinking reaction, for example, a catalyst such as an acid or an organometallic compound may be contained.

The water-insoluble resin used as the polymeric binder making up the transfer layer of the image-transfer medium for ink-jet printing according to the present invention will now be described. The water-insoluble resin may be suitably selected for use from among the conventionally-known water-insoluble thermoplastic resins. As described above, the term "thermoplastic resin" as used herein means a resin (generally, a linear polymeric compound) which becomes soft and exhibites a flowability by heating, and also, in addition to the above, it includes a three-dimensional crosslinked resin so far as it more or less exhibits a flexibility or a stickiness by heating. Described specifically, the water-insoluble thermoplastic resin may be suitably selected from the above-mentioned materials for the fine particles of the thermoplastic resin.

When the water-insoluble resin is used as the polymeric binder, a mixing ratio by weight of the fine particles of the thermoplastic resin to the water-insoluble resin is preferably within a range of from 1:2 to 50:1, more preferably from 1:2 to 20:1, most preferably 1:2 to 15:1. If the amount of the water-insoluble resin, or the polymeric binder, exceeds 1:2, the ink absorbency of the resulting transfer layer is deteriorated, resulting in a failure to provide a clear image. On the other hand, if the amount of the polymeric binder is less than 50:1, adhesion among the fine particles of the thermoplastic resin or between the fine particles and the releasing layer becomes insufficient, so that it is difficult to form a transfer layer having sufficient strength.

In the present invention, it is desirable that the melting point of such a material for the water-soluble or water-insoluble resin as described above be 200° C. or lower, preferably 180° C. or lower, more preferably 150° C. or lower, so that the resulting transfer layer may be easily transferred to cloth by means of a household iron or the like. As with the case of the fine particles of the thermoplastic resin, in the case of the thermoplastic resin material used as the polymeric binder, it is preferable to use a material, which can give a film having a high flexibility upon the formation of a film, in order not to impair hand of the cloth as much as possible after the formation of the transferred image.

A process for forming the transfer layer in the image-transfer medium for ink-jet printing according to the present invention by using the water-insoluble resin as the polymeric binder will now be described. When the water-insoluble resin is used as the polymeric binder, it is necessary to form the transfer layer in accordance with the following processes in such a manner that the fine particles of the thermoplastic resin in the transfer layer, in which a like material is used, exist in the transfer layer leaving the shape as the fine particles as they are. More specifically, as examples of the process for forming the transfer layer composed of the fine particles of the thermoplastic resin and the water-insoluble resin as the polymeric binder, may be mentioned a process in which a coating formulation, in which fine particles of at least two kinds of water-insoluble thermoplastic resins having different melting points are mixed, is applied to a base material, and the thus-coated base material is subjected to a heat treatment at a temperature higher than the melting point of the resin having a lower melting point, but lower than the melting point of the resin having a higher melting point to melt the water-insoluble thermoplastic resin having the lower melting point, thereby forming a transfer layer containing the fine particles of the thermoplastic resin having the higher melting point, and a process in which a coating formulation, in which fine particles of at least two kinds of water-insoluble thermoplastic resins are mixed, is applied to a base material, the thus-coated base material is dipped in a solvent in which only one resin is dissolved, thereby dissolving said one resin therein to form a film to form a transfer layer containing the fine particles of the other thermoplastic resin which is not dissolved in the solvent. In any process, the transfer layer is formed in a state that only the fine particles of one thermoplastic resin are formed into a film, and the fine particles of the other thermoplastic resin remain as they are, whereby the thermoplastic resin formed into the film functions as the polymeric binder. Accordingly, when the water-insoluble resin is used as the polymeric binder in the present invention, it is preferable to use a water-insoluble thermoplastic resin material having a melting point lower than that of a water-insoluble thermoplastic resin used as a material for the fine particles of the thermoplastic resin or a solubility in a specific solvent different from that of the material for the fine particles of the thermoplastic resin.

In the present invention, in order to enhance the film strength of the resulting transfer layer, it is effective to crosslink the water-insoluble resin used as the polymeric binder within limits not impairing the thermoplasticity of the resin to form the transfer layer. More specifically, there is mentioned a process in which a thermoplastic resin having reactive functional groups, or a prepolymer or oligomer thereof is combined with a crosslinking agent, and they are reacted by external energy such as heat and/or light during coating and drying of the mixture or after the coating, thereby crosslinking the resin. It is also effective to use a material having a crosslinkable functional group at terminals of a prepolymer or oligomer to crosslink the prepolymer or oligomer, thereby forming a transfer layer.

In the present invention, it is preferable to further contain finely particulate cellulose in the transfer layer of the image-transfer medium for ink-jet printing according to the present invention composed of such components as described above. By containing the finely particulate cellulose, the transfer layer is prevented from having a gloss or shining clearly, thereby providing a transferred image with the feeling of cloth retained satisfactorily. The finely particulate cellulose used in the present invention will hereinafter be described.

The finely particulate cellulose contained in the transfer layer of the image-transfer medium for ink-jet printing according to the present invention preferably has a particle diameter ranging from 0.1 to 50 $\mu$m, more preferably from 0.1 to 20 $\mu$m. If the particle diameter of the finely particulate cellulose is smaller than 0.1 $\mu$m, its effect for diminishing the glossy feeling on the surface of the transferred image becomes insufficient because it is too small. On the other hand, if the particle diameter exceeds 50 $\mu$m, a portion of cloth to which the resulting transfer layer has been transferred has a strongly rough feeling, so that hand of the cloth becomes poor at the image-transferred portion. As a method for obtaining finely particulate cellulose having such a particle diameter, for example, a method in which vegetable fiber is dried, and the resulting finely particulate cellulose is further ground into fine particles or finely particulate crystals can be used. In particular, when the image-transfer medium for ink-jet printing according to the present invention having the transfer layer containing such finely particulate cellulose as described above is used to form a transferred image on a cloth formed of cotton having a structure similar to that of the finely particulate cellulose or a blended yarn cloth of cotton and another fiber, hand of the transferred portion of the cloth is not impaired compared with a non-image formed portion of the cloth, so that a transferred cloth having good quality as a whole can be obtained.

When the finely particulate cellulose is contained in the transfer layer, the mixing ratio by weight of the fine particles of the thermoplastic resin to the finely particulate cellulose is preferably within a range of from 1:1 to 50:1, more preferably from 2:1 to 20:1. If the amount of the finely particulate cellulose is greater than 1:1, the amount of the fine particles of the thermoplastic resin to be melted is too small, and the strength of the resulting transferred image on cloth hence becomes weak, so that the transferred image is easy to be separated, or the transferred image layer cracks when the cloth is stretched, and so the underlying fiber is exposed. Therefore, a good transferred image may not be obtained in some cases. On the other hand, if the amount of the fine particles of the thermoplastic resin is greater than 50:1, the effect of the finely particulate cellulose is too weak, so that a good hand may not be obtained at the transferred portion of the cloth in some cases.

In the image-transfer medium for ink-jet printing according to the present invention, as described above, the transfer layer is formed from the fine particles of the thermoplastic resin and the polymeric binder (for example, a water-soluble or water-insoluble thermoplastic resin) by forming a film of the transfer layer with the polymeric binder in a state that the fine particles of the thermoplastic resin exist as fine particles as they are. Since the finely particulate cellulose is used as a further component of the transfer layer in the above-described constitution, however, it is necessary to form a transfer layer film that the fine particles of the thermoplastic resin and the finely particulate cellulose are contained in a state of particles in the polymeric binder. In this case, the mixing ratio of the sum of the fine particles of the thermoplastic resin and the finely particulate cellulose, which exist as particles, to the polymeric binder therefore becomes a problem. More specifically, when the water-soluble resin is used as the polymeric binder, the mixing ratio of the sum of the fine particles of the thermoplastic resin and the finely particulate cellulose to the water-soluble resin is preferably within a range of from 1:5 to 50:1, more preferably from 1:5 to 20:1, most preferably from 1:2 to 15:1. When the water-insoluble resin is used as the polymeric binder, the mixing ratio of the sum of the fine particles of the thermoplastic resin and the finely particulate cellulose to the water-insoluble resin is preferably within a range of from 1:2 to 50:1, more preferably from 1:2 to 20:1, most preferably from 1:2 to 15:1. If the amount of the polymeric binder is too great, the proportion of the polymeric binder in the resulting transfer layer becomes too high, so that in some cases, the resulting transferred image may be deteriorated, or hand of the cloth to which such a transferred image has been transferred may be impaired. On the other hand, if the amount of the polymeric binder is less than 50:1 in each case, adhesion among the fine particles of the thermoplastic resin or between the fine particles and the releasing layer becomes insufficient, so that a transfer layer film having sufficient strength may not be formed in some cases.

The film thickness of the transfer layer having such constitution as described above in the image-transfer medium for ink-jet printing according to the present invention is preferably within a range of from 1 to 100 $\mu$m, more preferably from 5 to 70 $\mu$m, most preferably from 10 to 50 $\mu$m in order to provide a good transferred image on a printing medium such as cloth.

Various kinds of additives may be added as components of the transfer layer in the image-transfer medium for ink-jet printing according to the present invention in addition to the fine particles of the thermoplastic resin, the polymeric binder, and the optionally added crosslinking agent and finely particulate cellulose. In the present invention, in particular, a cationic substance is used as an additive, whereby the water fastness of the resulting transferred image can be further enhanced. Examples of cationic substances usable as additives for the transfer layer in the present invention include the following substances:

Cationic polymers: cationically modified products of resins such as polyvinyl alcohol and hydroxyethyl cellulose, main-chain type cationic resins, polyallyl-amine, polyallyl sulfone, and amine resins such as polydiallylamine;

Cationic surfactants: primary, secondary and tertiary amine type compounds;

Hydrochlorides and/or acetates of lauryl amine, coconut amine, stearylamine and rosin amine;

Quaternary ammonium salt type compounds: lauryltrimethyl-ammonium chloride, lauryldimethylbenzylammonium chloride, benzyltributylammonium chloride and benzalkonium chloride;

Pyridinium salt type compounds: cetylpyridinium chloride and cetylpyridinium bromide;

Imidazoline type cationic compounds: 2-heptadecenyl-hydroxyethylimidazoline; and Ethylene oxide adducts of higher alkylamines: dihydroxyethylstearylamine.

In the present invention, it is also effective to add a plasticizer into the transfer layer from the viewpoint of enhancing transferability. By adding the plasticizer, the melt viscosity of the transfer layer becomes low upon its transfer, i.e., its heating, so that its adhesion to cloth can be more enhanced, and the transferability is improved. As the plasticizer usable in the present invention, any conventionally-known plasticizer may be used. Specific examples thereof include phthalates such as diethyl phthalate, dioctyl phthalate, dimethyl phthalate and dibutyl phthalate, phosphates such as tributyl phosphate and triphenyl phosphate, adipates such as octyl adipate and isononyl adipate, sebacates such as dibutyl sebacate and dioctyl sebacate, acetyltributyl citrate, acetyltriethyl citrate, dibutyl maleate, diethylhexyl maleate, dibutyl fumarate, trimellitic acid type plasticizers, polyester type plasticizers, epoxy type plasticizers, stearin type plasticizers, and paraffin chlorides. Water-soluble low-molecular substances such as diethylene glycol, ethylene glycol and glycerol are also effective as materials exhibiting a plasticizing effect.

In the present invention, in addition to the above-described cationic substances and plasticizers, other additives, for example, surfactants, penetrants, inorganic pigments, organic pigments, antiseptics and mildew-proofing agents may be added to the transfer layer within limits not lowering such functions as the transfer layer of the present invention as described above.

The releasing layer making up the image-transfer medium for ink-jet printing according to the present invention together with the transfer layer having such constitution as described above has an effect of facilitating the separation of the transfer layer from the base material at the time of transfer when the transfer layer is transferred to a printing medium such as cloth, thereby enhancing transferability.

Examples of a material used in the releasing layer in the present invention include, first of all, hot-melt materials, for example, waxes such as carnauba wax, paraffin wax, microcrystalline wax and castor wax, higher fatty acids and derivatives thereof such as metal salts and esters, for example, stearic acid, behenic acid, palmitic acid, lauric acid, ammonium stearate, lead stearate, barium stearate, zinc stearate, zinc palmitate, methyl hydroxystearate, glycerol monohydroxystearate and glycerol hydroxystearate, polyamide resins, petroleum resins, rosin derivatives, coumarone-indene resins, terpene resins, novolak resins, styrene resins, olefin resins such as polyethylene, polypropylene, polybutene and polyolefin oxide, vinyl ether resins, and hot-melt type nylon resins. Besides, silicone resins, fluorosilicone resins, fluoroolefin-vinyl ether copolymers, perfluoroepoxy resins, thermosetting acrylic resins having perfluoroalkyl groups at their side chains and vinyl fluoride- or vinylidene fluoride-based hardening paints may also be preferably used.

In the present invention, a further layer may be provided in addition to the above-described constitution. In particular, when a layer composed of a transparent uniform film having no ink absorbency is provided between the releasing layer and the transfer layer, a clearer image can be formed. When the porous transfer layer is directly provided on the releasing layer, and inks penetrate up to an interface between the releasing layer and the transfer layer upon printing, lifting occurs at the interface due to low adhesion between the two layers, and the inks tend to collect in that place, so that the cause of bleeding may be formed. When the layer composed of the transparent uniform film having no ink absorbency is provided between the releasing layer and the transfer layer, no floating (peeling) occurs because adhesion between the transfer layer and the uniform film layer is high. Accordingly, bleeding at the interface is prevented, so that a clearer image can be provided.

Materials used in this uniform film layer are required to be capable of forming a uniform film and have no ink absorbency and good adhesion to the transfer layer, and moreover to have high transparency so as not to adversely affect the resulting image because this layer is retained on the transfer layer after transfer. More specifically, any material may be used so far as it has no ink absorbency and can form a uniform film, and a water-insoluble resin may preferably be used.

As the base material on which the releasing layer and the transfer layer making up the image-transfer medium for ink-jet printing according to the present invention are formed, any conventional base material may be used so far as it can be carried in printers and has sufficient heat resistance to withstand a heat transfer treatment by heating and pressing. Specific examples thereof include synthetic resin films such as films of polyester, diacetate resins, triacetate resins, acrylic polymers, polycarbonate, polyvinyl chloride, polyimide, cellophane and celluloid. When a flexible material such as paper, fabric or nonwoven fabric is used as the base material, the image-transfer medium for ink-jet printing according to the present invention can be fitted to the shape of a transfer-printing medium even when the transfer-printing medium has curved surfaces, so that an image can be transferred to media other than flat media.

Processes for forming the releasing layer and the transfer layer on the base material in the present invention include a process in which preferable materials are suitably selected from among the materials mentioned above, respective coating formulations are prepared by dissolving or dispersing the selected materials in a suitable solvent, and the coating formulations are applied to a base material, a process in which a film composed of a releasing layer and a transfer layer is formed, and the film is laminated on a base material, and a process in which films are extruded on a base material to laminate them on one another. Examples of a method for applying the coating formulations include a roll coater, blade coater, air knife coater, gate roll coater, bar coater, size pressing, Symsizer, spray coating, gravure coating and curtain coater processes.

Such an image-transfer medium for ink-jet printing according to the present invention as described above is used as an intermediate image-transfer medium for an ink-jet printing method in which the image-transfer medium is charged in an ink-jet printing apparatus, ink-droplets are ejected and blown to a transfer layer to form an ink image on the transfer layer and the image is transferred to a printing medium such as cloth to form a transferred image on the cloth. More specifically, a process for transferring the image to the cloth includes placing a portion of the cloth to be transferred on the image-transfer medium for ink-jet printing according to the present invention from the side of the transfer layer on which the image has been formed, and heating and pressing the transfer layer from the side of the cloth or the base material to transfer the transfer layer to the cloth, thereby forming an image on the cloth. No particular limitation is imposed on the heating and pressing conditions upon the transfer. It is however preferable to suitably select optimum conditions according to the components of the transfer layer. The optimum conditions are determined in view of, for example, the melting points of the fine particles of the thermoplastic resin and the polymeric binder, the temperature and pressure at which the crosslinking agent can act on the water-soluble resin, and the heat resistance of cloth.

As an ink-jet printing apparatus used in the present invention, any commercially-available ink-jet printer commonly used may be employed as it is. No particular limitation is also imposed on coloring materials in inks to be used. For example, conventionally-known anionic coloring materials may be used. It is not necessary to specially change the kinds of coloring materials according to fibers making up cloths.

No particular limitation is also imposed on the cloth used in forming a transferred image using the image-transfer medium for ink-jet printing according to the present invention. For example, any of natural fibers such as cotton, hemp, silk, wool and rayon, synthetic fibers such as polyester, nylon, acrylic, acetate, triacetate and polyurethane, and blended fibers thereof may be used as fiber making up the cloth. The cloth may be used in any form of a woven fabric, a knit fabric and a nonwoven fabric.

Figure 2:
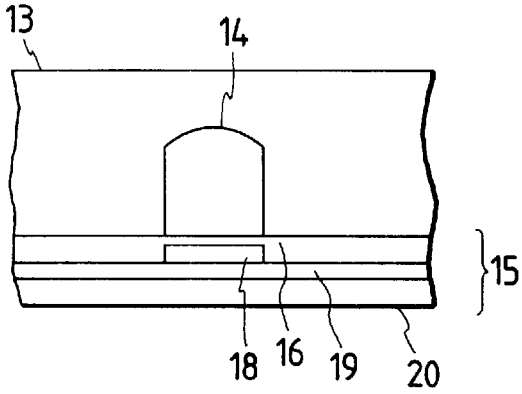
FIG. 2 is a transverse cross-sectional view of the head of the ink-jet printing apparatus.
Figure 3:
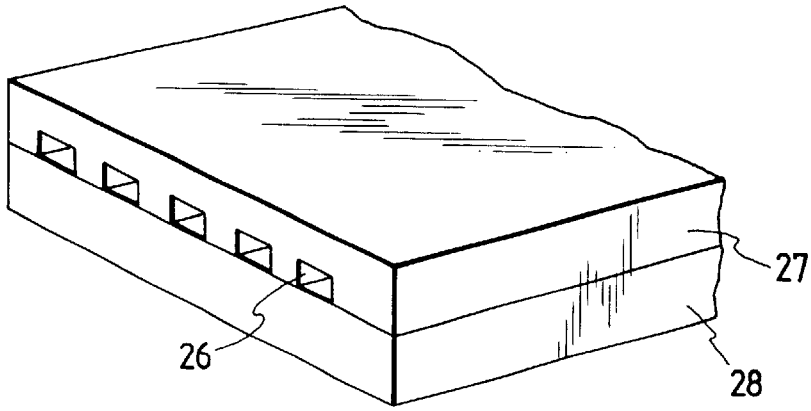
FIG. 3 is a perspective view of the appearance of a multi-head which is an array of such heads as shown in FIG. 1.

An illustrative ink-jet printing apparatus, which is suitable for use in conducting printing on the transfer layer of the above-described image-transfer medium for ink-jet printing according to the present invention, will hereinafter be described. Examples of the construction of a head, which is a main component of such an apparatus, are illustrated in FIGS. 1, 2 and 3.

A head 13 is formed by bonding a glass, ceramic, plastic plate or the like having a groove 14 through which ink is passed, to a heating head 15 used in thermal recording (the drawings show a thin-film head to which, however, the invention is not limited). The heating head 15 is composed of a protective film 16 formed of silicon oxide or the like, aluminum electrodes 17-1 and 17-2, a heating resistor layer 18 formed of nichrome or the like, a heat accumulating layer 19, and a substrate 20 made of alumina or the like having a good heat radiating property.

An ink 21 comes up to an ejection orifice (a minute opening) 22 and forms a meniscus 23 due to a pressure (not illustrated).

Now, upon application of electric signals to the electrodes 17-1, 17-2, the heating head 15 rapidly generates heat at the region shown by n to form bubbles in the ink 21 which is in contact with this region. The meniscus 23 of the ink is projected by the action of the pressure thus produced, and the ink 21 is ejected from the ejection orifice 22 to a printing medium 25 in the form of ink droplets 24.

FIG. 3 illustrates an appearance of a multi-head composed of an array of a number of heads as shown in FIG. 1. The multi-head is formed by closely bonding a glass plate 27 having a number of grooves 26 to a heating head 28 similar to the heating head illustrated in FIG. 1.

Incidentally, FIG. 1 is a cross-sectional view of a head taken along a flow path of the ink, and FIG. 2 is a cross-sectional view taken along line 2—2 in FIG. 1.

Figure 4:
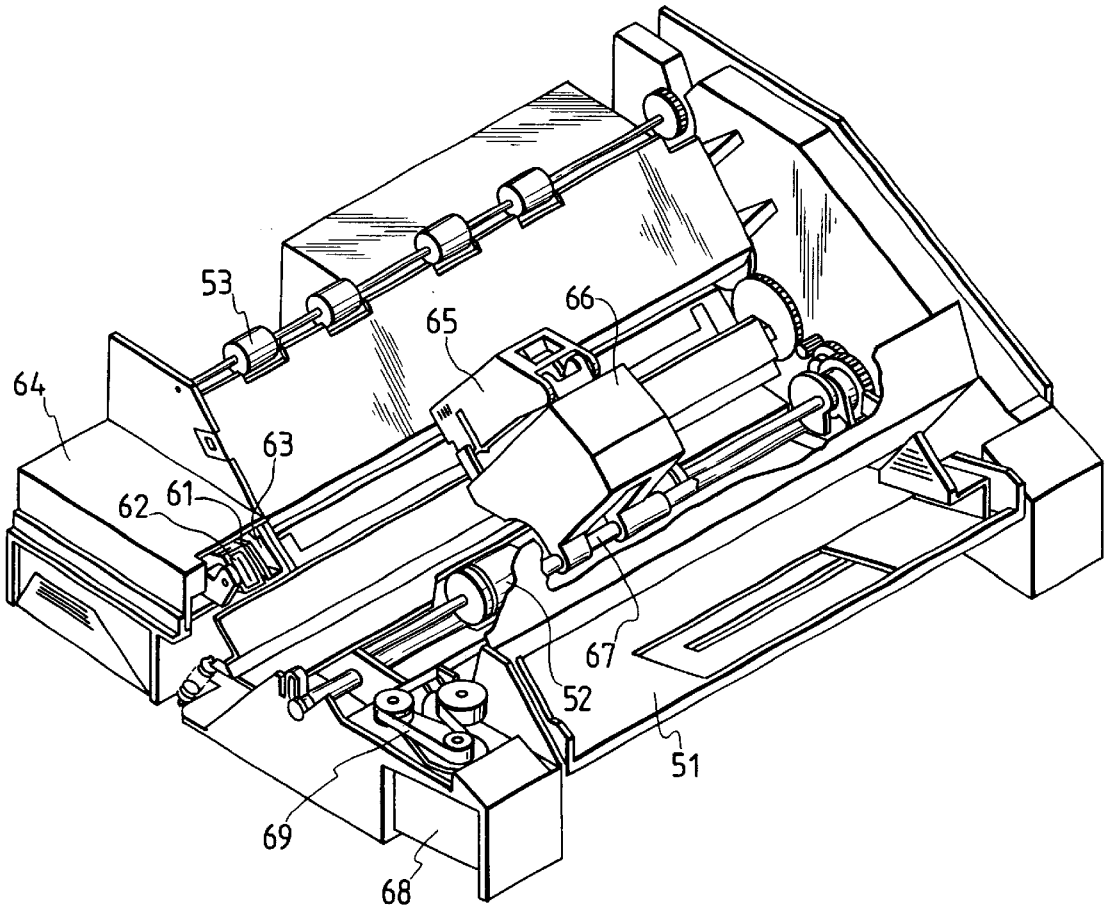
FIG. 4 is a perspective view of an illustrative ink-jet printing apparatus.

FIG. 4 illustrates an example of an ink-jet printing apparatus in which the above head has been incorporated.

In FIG. 4, reference numeral 61 designates a blade serving as a wiping member, one end of which is a stationary end held by a blade-holding member to form a cantilever. The blade 61 is provided at the position adjacent to the region in which a printing head 65 operates, and in this embodiment, is held in such a form that it protrudes into the course through which the printing head 65 is moved.

Reference numeral 62 indicates a cap for an ejection opening face of the printing head 65, which is provided at the home position adjacent to the blade 61, and is so constituted that it moves in the direction perpendicular to the direction in which the printing head 65 is moved and comes into contact with the face of ejection openings to cap it. Reference numeral 63 denotes an absorbing member provided adjoiningly to the blade 61 and, similar to the blade 61, held in such a form that it protrudes into the course through which the printing head 65 is moved.

The above-described blade 61, cap 62 and absorbing member 63 constitute an ejection-recovery portion 64, where the blade 61 and absorbing member 63 remove water, dust and/or the like from the face of the ink-ejecting openings.

Reference numeral 65 designates the printing head having an ejection-energy-generating means and serving to eject the ink onto the printing medium set in an opposing relation to the ejection opening face provided with ejection openings to conduct printing. Reference numeral 66 indicates a carriage on which the printing head 65 is mounted so that the printing head 65 can be moved.

The carriage 66 is slidably interlocked with a guide rod 67 and is connected (not illustrated) at its part to a belt 69 driven by a motor 68. Thus, the carriage 66 can be moved along the guide rod 67 and hence, the printing head 65 can be moved from a printing region to a region adjacent thereto.

Reference numerals 51 and 52 denote a feeding part from which printing media are separately inserted, and feed rollers driven by a motor (not illustrated), respectively. With such a construction, the printing medium is fed to the position opposite to the ejection opening face of the printing head 65, and discharged from a discharge section provided with discharge rollers 53 with the progress of printing.

In the above construction, the cap 62 in the head recovery portion 64 is receded from the path of motion of the printing head 65 when the printing head 65 is returned to its home position, for example, after completion of printing, and the blade 61 remains protruded into the path of motion. As a result, the ejection opening face of the printing head 65 is wiped. When the cap 62 comes into contact with the ejection opening face of the printing head 65 to cap it, the cap 62 is moved so as to protrude into the path of motion of the printing head 65.

When the printing head 65 is moved from its home position to the position at which printing is started, the cap 62 and the blade 61 are at the same positions as the positions for the wiping as described above. As a result, the ejection opening face of the printing head 65 is also wiped at the time of this movement.

The above movement of the printing head 65 to its home position is made not only when the printing is completed or the printing head 65 is recovered for ejection, but also when the printing head 65 is moved between printing regions for the purpose of printing, during which it is moved to the home position adjacent to each printing region at given intervals, where the ejection opening face is wiped in accordance with this movement.

Figure 5:
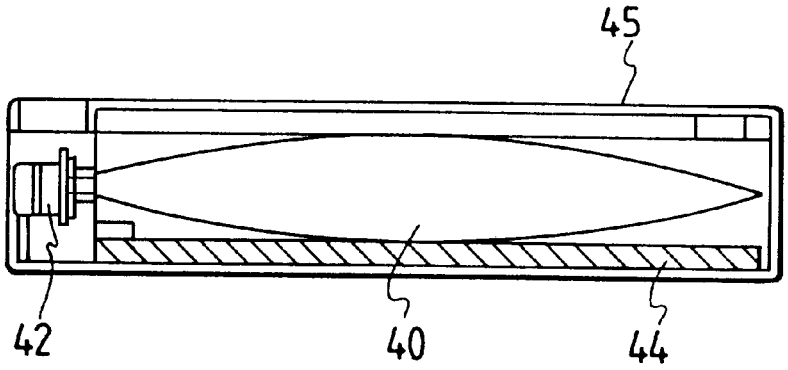
FIG. 5 is a longitudinal cross-sectional view of an ink cartridge.

FIG. 5 illustrates an exemplary ink cartridge 45 in which an ink to be fed to the head through an ink-feeding member, for example, a tube is contained.

Here, reference numeral 40 designates an ink container portion containing the ink to be fed, as exemplified by a bag for the ink. One end thereof is provided with a stopper 42 made of rubber. A needle (not illustrated) may be inserted into this stopper 42 so that the ink in the bag 40 for the ink can be fed to the head. Reference numeral 44 indicates an ink-absorbing member for receiving a waste ink.

In this invention, it is preferable that the ink container portion be formed of a polyolefin, in particular, polyethylene, at its surface with which the ink comes into contact.

The ink-jet printing apparatus used in the present invention are not limited to the apparatus as described above in which the head and the ink cartridge are separately provided. Therefore, a device in which these members are integrally formed as shown in FIG. 6 can also be preferably used.

Figure 6:
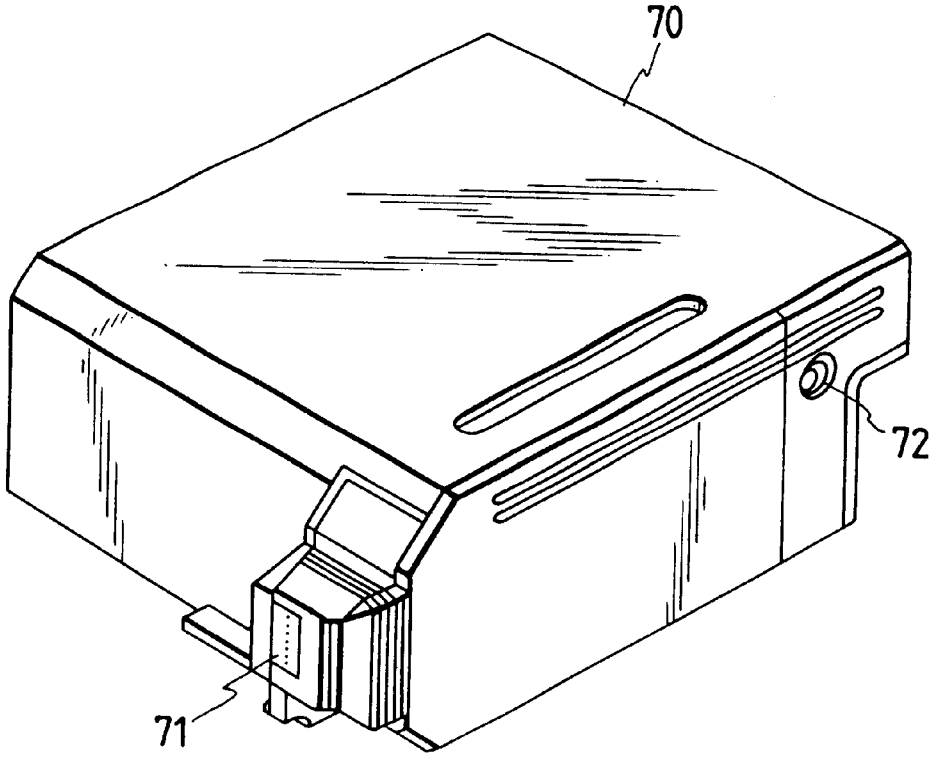
FIG. 6 is a perspective view of an illustrative printing unit.

In FIG. 6, reference numeral 70 designates a printing unit, in the interior of which an ink container portion containing an ink, for example, an ink-absorbing member, is contained. The printing unit 70 is so constructed that the ink in such an ink-absorbing member is ejected in the form of ink droplets through a head 71 having a plurality of orifices.

In the present invention, polyurethane, cellulose or polyvinyl acetal is preferably used as a material for the ink-absorbing member. Reference numeral 72 indicates an air passage for communicating the interior of the printing unit 70 with the atmosphere. This printing unit 70 can be used in place of the printing head 65 shown in FIG. 4, and is detachably installed on the carriage 66.

The present invention will hereinafter be described more specifically by the following Examples and Comparative Example. Incidentally, all designations of "part" or "parts" and "%" as will be used in the following examples mean part or parts by weight and % by weight unless expressly noted.

EXAMPLE 1

Paper for PPC (Plain Paper Copier) having a basis weight of 64 g/m$^2$ was used as a base material, and a vinyl monofluoride resin film having a thickness of 20 $\mu$m was laminated on this base material to provide a releasing layer. To this releasing layer, a coating formulation composed of Composition A containing fine particles of a thermoplastic resin and a water-soluble resin and having the following formulation was then applied by a bar coater process, so as to give a dry coating thickness of 40 $\mu$m. The thus-coated base material was dried at 60° C. for 10 minutes in a drying oven to provide a transfer layer, thereby producing an image-transfer medium.

| [Composition A] | |
|---|---|
| Ethylene-vinyl acetate (EVA) emulsion (Chemipearl V-300, trade name, product of Mitsui Petrochemical Industries, Ltd.; particle diameter: 6 $\mu$m; solid content: 40%) | 250 parts |
| Polyvinyl alcohol (PVA-217, trade name, product of Kuraray Co., Ltd.; solid content: 20%) | 50 parts |

EXAMPLE 2

A releasing layer was provided on a base material composed of paper for PPC in the same manner as in Example 1. On this releasing layer, a transfer layer was further provided in accordance with the same process as in Example 1 by using a coating formulation composed of Composition B containing fine particles of a thermoplastic resin, a water-soluble resin and cationic substances and having the following formulation, thereby producing an image-transfer medium.

| [Composition B] | |
|---|---|
| Ethylene-vinyl acetate emulsion (Chemipearl V-300, trade name, product of Mitsui Petrochemical Industries, Ltd.; particle diameter: 6 $\mu$m; solid content: 40%) | 250 parts |
| Polyvinyl alcohol (PVA-217, trade name, product of Kuraray Co., Ltd.; solid content: 20%) | 50 parts |
| Polyallylamine hydrochloride (PAA-HCl-10L, trade name, product of Nitto Boseki Co., Ltd.; solid content: 40%) | 12 parts |
| Benzalkonium chloride (G-50, trade name, product of Sanyo Chemical Industries, Ltd.; solid content: 50%) | 6 parts |

EXAMPLE 3

A polyethylene terephthalate (PET) film having a thickness of 100 $\mu$m was used as a base material, and a vinyl monofluoride resin film having a thickness of 20 $\mu$m was laminated on this base material to provide a releasing layer. To this releasing layer, a coating formulation composed of Composition C containing fine particles of a thermoplastic resin and a water-soluble resin and having the following formulation was then applied by a bar coater process, so as to give a dry coating thickness of 40 $\mu$m. The thus-coated base material was dried at 80° C. for 5 minutes in a drying oven to provide a transfer layer, thereby producing an image-transfer medium.

| [Composition C] | |
|---|---|
| Fine particles of nylon (orgasol 3501, trade name, product of Nihon Rilsan KK; particle diameter: 10 $\mu$m) | 100 parts |
| Polyhydroxyethyl cellulose (AH-15, trade name, product of Fuji Chemical Co., Ltd.; 5% aqueous solution) | 600 parts |

EXAMPLE 4

A releasing layer was provided on a base material composed of a polyethylene terephthalate film in the same manner as in Example 3. On this releasing layer, a transfer layer was further provided in accordance with the same process as in Example 3 by using a coating formulation composed of Composition D containing fine particles of a thermoplastic resin, a water-soluble resin and cationic substances and having the following formulation, thereby producing an image-transfer medium.

| [Composition D] | |
|---|---|
| Fine particles of nylon (Orgasol 3501, trade name, product of Nihon Rilsan K.K.; particle diameter: 10 μm) | 100 parts |
| Polyhydroxyethyl cellulose (AH-15, trade name, product of Fuji Chemical Co., Ltd.; 5% aqueous solution) | 600 parts |
| Polyallylamine hydrochloride (PAA-HCl-10L, trade name, product of Nitto Boseki Co., Ltd.; solid content: 40%) | 15 parts |
| Benzalkonium chloride (G-50, trade name, product of Sanyo Chemical Industries, Ltd.; solid content: 50%) | 8 parts |

COMPARATIVE EXAMPLE 1

Paper for PPC having a basis weight of 64 g/m$^2$ was used as a base material and coated with a coating formulation composed of a composition having the following formulation by a bar coater process so as to give a dry coating thickness of 40 μm. The thus-coated base material was dried at 60° C. for 10 minutes in a drying oven to provide a transfer layer, thereby producing an image-transfer medium for comparison.

| [Composition] | |
|---|---|
| Fine particles of silica (Sylysia 450, trade name, product of Fuji Silysia K.K.; particle diameter: 5 μm) | 10 parts |
| Polyvinyl alcohol (PVA-217, trade name, product of Kuraray Co., Ltd.; solid content: 20%) | 100 parts |

[Printing and Evaluation]

Printing (mirror-image printing) was conducted on the thus-produced image-transfer media of Examples 1 to 4 and Comparative Example 1 (their compositions and film-forming conditions for the transfer layers being shown collectively in Table 1) in accordance with a back printing film mode by means of an ink-jet color printer, BJC-600J (trade name, manufactured by Canon Inc.). After the printing, each of the printed image-transfer media was placed on a 100% cotton fabric for T-shirt with the transfer layer aligned with a portion of the fabric to be transferred. The transfer layer was transferred to the fabric by ironing from the base material side of the image-transfer medium. The temperature of an iron was controlled to a moderate temperature to conduct the transfer for 20 seconds. The respective transferred images thus formed were evaluated as to the following items in accordance with the following evaluation methods.

<Transferability (image density)>

The image density of the transferred image after transferred to the fabric for T-shirt using each of the image-transfer media obtained in Examples 1 to 4 and Comparative Example 1 was measured to evaluate the transferability. The measuring method was as follows. After an image was formed on each of the image-transfer media of Examples 1 to 4 and Comparative Example 1 in accordance with the above-described printing process, a transferred image with a black print patch of a 100% duty, in which dots were formed in the whole pixels, was formed on a fabric for T-shirt, whereby the image density of the image after the transfer was measured by means of a reflection densitometer, Macbeth RD-918 (trade name, manufactured by Macbeth Co.) to evaluate the transferability. The transferability of each sample was ranked as A where the image density was 1.2 or higher, B where the image density was lower than 1.2 but not lower than 1.0, or C where the image density was lower than 1.0. The evaluation results are shown in Table 4.

<Bleeding>

After an image was formed on each of the image-transfer media obtained in Examples 1 to 4 and Comparative Example 1 in accordance with the above-described printing process to form a transferred image with adjoiningly printed black and magenta print patches of 100% duty, in which dots were formed in the whole pixels, on a fabric for T-shirt, bleeding at a boundary between the two colors was visually observed. The resistance to bleeding of each sample was ranked as A where no bleeding occurred at the boundary between the two colors, or C where bleeding occurred at the boundary. The evaluation results are shown in Table 4.

<Fastness to Laundering>

Each of the image-transfer media obtained in Examples 1 to 4 and Comparative Example 1 was used to form an image on the image-transfer medium in accordance with the above-described printing process, thereby forming a transfer solid print with black, cyan, magenta and yellow print patches (each, about 15×15 mm) of 100% duty, in which dots were formed in the whole pixels, on a fabric for T-shirt. After the thus-obtained printed fabrics for T-shirt on which the transferred image with the black, cyan, magenta and yellow print patches had been formed were separately washed by hands for 2 minutes in tepid water of 30° C. and air dried, the transferred images were visually observed, thereby evaluating them as to the fastness to laundering. The fastness to laundering of each sample was ranked as A where the transfer layer was not dissolved in the tepid water but closely adhered to the fabric, or C where the transfer layer was dissolved in the tepid water. The evaluation results are shown in Table 4.

TABLE 1

| | Composition of transfer layer | | | | | |
|---|---|---|---|---|---|---|
| | Composition of transfer layer | Parts | Solid content | Ratio | Base material | Film forming condition |
| Ex. 1 | Ethylene-vinyl acetate emulsion (6 μm) | 250 | 100 | 10:1 | Paper for PPC coated with 20 μm vinyl fluoride resin | 60° C. 10 min |
| | Polyvinyl alcohol | 50 | 10 | | | Thickness: 40 μm |
| Ex. 2 | Ethylene-vinyl acetate emulsion (6 μm) | 250 | 100 | 10:1 | Paper for PPC coated with 20 μm vinyl fluoride resin | 60° C. 10 min |
| | Polyvinyl alcohol | 50 | 10 | | | |
| | Polyallylamine hydrochloride | 12 | 4.8 | | | Thickness: 40 μm |
| | Benzalkonium chloride | 6 | 3 | | | |

TABLE 1-continued

| | Composition of transfer layer | Parts | Solid content | Ratio | Base material | Film forming condition |
|---|---|---|---|---|---|---|
| | Composition of transfer layer | | | | | |
| Ex. 3 | Fine particles of nylon (10 μm) | 100 | 100 | 3.3:1 | PET film coated with 20 μm vinyl fluoride resin | 80° C. 5 min Thickness: 40 μm |
| | Polyhydroxyethyl cellulose | 600 | 30 | | | |
| Ex. 4 | Fine particles of nylon (10 μm) | 100 | 100 | 3.3:1 | PET film coated with 20 μm vinyl fluoride resin | 80° C. 5 min Thickness: 40 μm |
| | Polyhydroxyethyl cellulose | 600 | 30 | | | |
| | Polyallylamine hydrochloride | 15 | 6 | | | |
| | Benzalkonium chloride | 8 | 4 | | | |
| Comp. Ex. 1 | Fine particles of silica (5 μm) | 10 | 10 | 1:2 | Paper for PPC (coated with no releasing layer) | 60° C. 10 min Thickness: 40 μm |
| | Polyvinyl alcohol | 100 | 20 | | | |

The ratio in Table 1 was a value of (the fine particles of the thermoplastic resin/the water-soluble resin) for each example, and a value of (the fine particles of silica/the water-soluble resin) for the comparative example.

EXAMPLE 5

Paper for PPC having a basis weight of 64 g/m$^2$ was used as a base material, and a vinyl monofluoride resin film having a thickness of 20 μm was laminated on this base material to provide a releasing layer. To this releasing layer, a coating formulation composed of Composition E containing fine particles of a thermoplastic resin, a water-soluble resin and a crosslinking agent and having the following formulation was then applied by a bar coater process, so as to give a dry coating thickness of 40 μm. The thus-coated base material was dried at 60° C. for 10 minutes in a drying oven to provide a transfer layer, thereby producing an image-transfer medium.

| [Composition E] | |
|---|---|
| Ethylene-vinyl acetate emulsion (Chemipearl V-300, trade name, product of Mitsui Petrochemical Industries, Ltd.; particle diameter: 6 μm; solid content: 40%) | 250 parts |
| Polyvinyl alcohol (PVA-217, trade name, product of Kuraray Co., Ltd.; 20% aqueous solution) | 50 parts |
| Isocyanate (Elastron BN-5, trade name, product of Dai-ichi Kogyo Seiyaku Co., Ltd.; 15% aqueous solution) | 7 parts |
| Organotin compound (Catalyst 64, trade name, product of Dai-ichi Kogyo Seiyaku Co., Ltd.) | 0.5 part |

EXAMPLE 6

A releasing layer was provided on a base material composed of paper for PPC in the same manner as in Example 5. On this releasing layer, a transfer layer was further provided in accordance with the same process as in Example 5 by using a coating formulation composed of Composition F containing fine particles of a thermoplastic resin, a water-soluble resin, a crosslinking agent and cationic compounds and having the following formulation, thereby producing an image-transfer medium.

| [Composition F] | |
|---|---|
| Ethylene-vinyl acetate emulsion (Chemipearl V-300, trade name, product of Mitsui Petrochemical Industries, Ltd.; particle diameter: 6 μm; solid content: 40%) | 250 parts |
| Polyvinyl alcohol (PVA-217, trade name, product of Kuraray Co., Ltd.; 20% aqueous solution) | 50 parts |
| Isocyanate (Elastron BN-5, trade name, product of Dai-ichi Kogyo Seiyaku Co., Ltd.; 15% aqueous solution) | 7 parts |
| Organotin compound (Catalyst 64, trade name, product of Dai-ichi Kogyo Seiyaku Co., Ltd.) | 0.5 parts |
| Polyallylamine hydrochloride (PAA-HCl-10L, trade name, product of Nitto Boseki Co., Ltd.; 40% aqueous solution) | 12 parts |
| Benzalkonium chloride (G-50, trade name, product of Sanyo Chemical Industries, Ltd.; 50% aqueous solution) | 6 parts |

EXAMPLE 7

A polyethylene terephthalate film having a thickness of 100 μm was used as a base material, and a releasing layer was provided on this base material in the same manner as in Example 5. To this releasing layer, a coating formulation composed of Composition G containing fine particles of a thermoplastic resin, a water-soluble resin, a crosslinking agent and cationic compounds and having the following formulation was then applied by a bar coater process, so as to give a dry coating thickness of 40 μm. The thus-coated base material was dried at 80° C. for 5 minutes in a drying oven to provide a transfer layer, thereby producing an image-transfer medium.

| [Composition G] | |
|---|---|
| Ethylene-vinyl acetate emulsion (Chemipearl V-300, trade name, product of Mitsui Petrochemical Industries, Ltd.; particle diameter: 6 μm; solid content: 40%) | 250 parts |
| Polyvinyl alcohol (PVA-217, trade name, product of Kuraray Co., Ltd.; 20% aqueous solution) | 50 parts |
| Alumina (Alumina Sol-200, trade name, product of Nissan Chemical Industries, Ltd.; 10% aqueous solution) | 5 parts |
| Polyallylamine hydrochloride (PAA-HCl-10L, trade name, product of Nitto Boseki Co., Ltd., 40% aqueous solution) | 12 parts |
| Benzalkonium chloride (G-50, trade name, product of Sanyo Chemical Industries, Ltd.; 50% aqueous solution) | 6 parts |

EXAMPLE 8

A releasing layer was provided on a base material composed of a polyethylene terephthalate film in the same manner as in Example 7. On this releasing layer, a transfer layer was further provided in accordance with the same process as in Example 7 by using a coating formulation composed of Composition H containing fine particles of a thermoplastic resin, a water-soluble resin, a crosslinking agent and cationic compounds and having the following formulation, thereby producing an image-transfer medium.

| [Composition H] | |
|---|---|
| Fine particles of nylon (Orgasol 3501, trade name, product of Nippon Phosphoric Acid Co., Ltd.; particle diameter: 10 μm) | 100 parts |
| Polyhydroxyethyl cellulose (AH-15, trade name, product of Fuji Chemical Co., Ltd.; 5% aqueous solution) | 600 parts |
| Bisphenol A type epoxy resin-encapsulated powder (Matsumoto Microsphere EP-28, trade name, product of Matsumoto Yushi-Seiyaku Co., Ltd.) | 8 parts |
| Zinc borofluoride (Hofukkaaen, trade name, product of Wako Pure Chemical Industries, Ltd.; 45% aqueous solution) | 2 parts |
| Polyallylamine hydrochloride (PAA-HCl-10L, trade name, product of Nitto Boseki Co., Ltd.; 40% aqueous solution) | 15 parts |
| Benzalkonium chloride (G-50, trade name, product of Sanyo Chemical Industries, Ltd.; 50% aqueous solution) | 8 parts |

EXAMPLE 9

A releasing layer was provided on a base material composed of paper for PPC in the same manner as in Example 5. On this releasing layer, a transfer layer was further provided in accordance with the same process as in Example 5 by using a coating formulation composed of Composition I containing fine particles of a thermoplastic resin, a crosslinkable water-soluble resin, a crosslinking agent and cationic compounds and having the following formulation, thereby producing an image-transfer medium.

| [Composition I] | |
|---|---|
| Fine particles of nylon (Orgasol 3501, trade name, product of Nihon Rilsan K.K.; particle diameter: 10 μm) | 100 parts |
| Heat-reactive aqueous urethane resin (Elastron MF-25, trade name, product of Dai-ichi Kogyo Seiyaku Co., Ltd.; solid content: 25%) | 400 parts |

-continued

| [Composition I] | |
|---|---|
| Organotin compound (Catalyst 64, trade name, product of Dai-ichi Kogyo Seiyaku Co., Ltd.) | 40 parts |
| Polyallylamine hydrochloride (PAA-HCl-10L, trade name, product of Nitto Boseki Co., Ltd.; 40% aqueous solution) | 23 parts |
| Benzalkonium chloride (G-50, trade name, product of Sanyo Chemical Industries, Ltd.; 50% aqueous solution) | 250 parts |

[Printing and Evaluation]

Printing (mirror-image printing) was conducted on the thus-produced image-transfer media of Examples 5 to 9 (their compositions and film-forming conditions for the transfer layers being shown collectively in Table 2) in accordance with a back printing film mode by means of an ink-jet color printer, BJC-600J (trade name, manufactured by Canon Inc.). After the printing, each of the printed image-transfer media was placed on a 100% cotton fabric for T-shirt with the transfer layer aligned with a portion of the fabric to be transferred. The transfer layer was transferred to the fabric by ironing from the base material side of the image-transfer medium. The temperature of an iron was controlled to a high temperature to conduct the transfer for 60 seconds. The respective transferred images thus formed were evaluated as to the following items in accordance with the following evaluation methods.

<Transferability (Image Density)>

The image density of each transferred image with the black print patch was measured in the same manner as in Examples 1 to 4 and Comparative Example 1 to evaluate the transferability. Similarly, the transferability of each sample was ranked as A where the image density was 1.2 or higher, B where the image density was lower than 1.2 but not lower than 1.0, or C where the image density was lower than 1.0. The evaluation results are shown in Table 4.

<Bleeding>

Bleeding at a boundary between two colors of each transferred image with the black and magenta print patches was visually observed in the same manner as in Examples 1 to 4 and Comparative Example 1 to evaluate the resistance to bleeding. Similarly, the resistance to bleeding of each sample was ranked as A where no bleeding occurred at the boundary between the two colors, or C where bleeding occurred at the boundary. The evaluation results are shown in Table 4.

<Fastness to Laundering>

The fastness to laundering of each transferred image with the black, cyan, magenta and yellow print patches was evaluated in the same manner as in Examples 1 to 4 and Comparative Example 1. The fastness to laundering of each sample was ranked as AA where the image was not deteriorated, A where only a part of the dyes exuded, B where the image density was lowered to a considerable extent, or C where the transfer layer was dissolved in the tepid water. The evaluation results are shown in Table 4.

TABLE 2

Composition of transfer layer (Examples 5 to 9)

| | Composition of transfer layer | Parts | Solid content | Ratio | Base material | Film forming condition |
|---|---|---|---|---|---|---|
| Ex. 5 | EVA emulsion (6 μm) | 250 | 100 | 10:1 | Paper for PPC coated with 20 μm vinyl fluoride resin | 60° C. 10 min Thickness: 40 μm |
| | PVA | 50 | 10 | | | |
| | Isocyanate | 7 | 1.05 | | | |
| | Organotin compound | 0.5 | | | | |
| Ex. 6 | EVA emulsion (6 μm) | 250 | 100 | 10:1 | Paper for PPC coated with 20 μm vinyl fluoride resin | 60° C. 10 min Thickness: 40 μm |
| | PVA | 50 | 10 | | | |
| | Isocyanate | 7 | 1.05 | | | |
| | Organotin compound | 0.5 | | | | |
| | Polyallylamine hydrochloride | 12 | 4.8 | | | |
| | Benzalkonium chloride | 6 | 3 | | | |
| Ex. 7 | EVA emulsion (6 μm) | 250 | 100 | 10:1 | PET film coated with 20 μm vinyl fluoride resin | 80° C. 5 min Thickness: 40 μm |
| | PVA | 50 | 10 | | | |
| | Alumina | 7 | 0.5 | | | |
| | Polyallylamine hydrochloride | 12 | 4.8 | | | |
| | Benzalkonium chloride | 6 | 3 | | | |
| Ex. 8 | Fine particles of nylon (10 μm) | 100 | 100 | 3.3:1 | PET film coated with 20 μm vinyl fluoride resin | 80° C. 5 min Thickness: 40 μm |
| | Polyhydroxyethyl cellulose | 600 | 30 | | | |
| | Bisphenol A type epoxy resin-encapsulated powder | 8 | 8 | | | |
| | Zinc borofluoride | 2 | 0.9 | | | |
| | Polyallylamine hydrochloride | 15 | 6 | | | |
| | Benzalkonium chloride | 8 | 4 | | | |
| Ex. 9 | Fine particles of nylon (10 μm) | 100 | 100 | 1:1 | Paper for PPC coated with 20 μm vinyl fluoride resin | 60° C. 10 min Thickness: 40 μm |
| | Heat-reactive aqueous urethane resin | 400 | 100 | | | |
| | Organotin compound | 40 | | | | |
| | Polyallylamine hydrochloride | 23 | 9.2 | | | |
| | Benzalkonium chloride | 250 | 125 | | | |

The ratio in Table 2 was a value of (the fine particles of the thermoplastic resin/the water-soluble resin).

EXAMPLE 10

Paper for PPC having a basis weight of 64 g/m$^2$ was used as a base material, and a vinyl monofluoride resin film having a thickness of 20 μm was laminated on this base material to provide a releasing layer. To this releasing layer, a coating formulation composed of Composition J containing fine particles of a thermoplastic resin and a water-insoluble resin as a binder and having the following formulation was then applied by a bar coater process, so as to give a dry coating thickness of 40 μm. The thus-coated base material was dried at 60° C. for 10 minutes in a drying oven to provide a transfer layer, thereby producing an image-transfer medium.

| [Composition J] | |
|---|---|
| Ethylene-vinyl acetate emulsion (Chemipearl V-300, trade name, product of Mitsui Petrochemical Industries, Ltd.; particle diameter: 6 μm; solid content: 40%) | 250 parts |

-continued

| [Composition J] | |
|---|---|
| Ionomer emulsion (Chemipearl SA-100, trade name, product of Mitsui Petrochemical Industries, Ltd.; particle diameter: smaller than 1 μm; solid content: 35%) | 28 parts |

EXAMPLE 11

A releasing layer was provided on a base material composed of paper for PPC in the same manner as in Example 10. On this releasing layer, a transfer layer was further provided in accordance with the same process as in Example 10 by using a coating formulation composed of Composition K containing fine particles of a thermoplastic resin, a water-insoluble resin as a binder and cationic compounds and having the following formulation, thereby producing an image-transfer medium.

| [Composition K] | |
|---|---|
| Ethylene-vinyl acetate emulsion (Chemipearl V-300, trade name, product of Mitsui Petrochemical Industries, Ltd.; particle diameter: 6 μm; solid content: 40%) | 250 parts |

-continued

| [Composition K] | |
|---|---|
| Ionomer emulsion (Chemipearl SA-100, trade name, product of Mitsui Petrochemical Industries, Ltd.; particle diameter: smaller than 1 μm; solid content: 35%) | 28 parts |
| Polyallylamine hydrochloride (PAA-HCl-10L, trade name, product of Nitto Boseki Co., Ltd.; solid content: 40%) | 12 parts |
| Benzalkonium chloride (G-50, trade name, product of Sanyo Chemical Industries, Ltd.; solid content: 50%) | 6 parts |

EXAMPLE 12

A polyethylene terephthalate film having a thickness of 100 μm was used as a base material, and a vinyl monofluoride resin film having a thickness of 20 μm was laminated on this base material to provide a releasing layer. To this releasing layer, a coating formulation composed of Composition L containing fine particles of a thermoplastic resin and a heat-reactive thermoplastic resin as a binder and having the following formulation was then applied by a bar coater process, so as to give a dry coating thickness of 40 μm. The thus-coated base material was dried at 100° C. for 5 minutes in a drying oven and then cured at 150° C. for 5 minutes to provide a transfer layer, thereby producing an image-transfer medium. The polymeric binder contained in the transfer layer formed in this example is a water-insoluble resin crosslinked by heat.

| [Composition L] | |
|---|---|
| Fine particles of nylon (Orgasol 3501, trade name, product of Nihon Rilsan K.K.; particle diameter: 10 μm) | 100 parts |
| Heat-reactive aqueous urethane resin (Elastron MF-25, trade name, product of Dai-ichi Kogyo Seiyaku Co., Ltd.; solid content: 25%) | 400 parts |
| Organotin compound (Catalyst 64, trade name, product of Dai-ichi Kogyo Seiyaku Co., Ltd.) | 40 parts |

EXAMPLE 13

A releasing layer was provided on a base material composed of a polyethylene terephthalate film in the same manner as in Example 12. On this releasing layer, a transfer layer was further provided in accordance with the same process as in Example 12 by using a coating formulation composed of Composition M containing fine particles of a thermoplastic resin, a heat-reactive thermoplastic resin, a crosslinking agent and cationic compounds and having the following formulation, thereby producing an image-transfer medium. The polymeric binder contained in the transfer layer formed in this example is also a water-insoluble resin crosslinked by heat as with Example 12.

| [Composition M] | |
|---|---|
| Fine particles of nylon (Orgasol 3501, trade name, product of Nihon Rilsan K.K.; particle diameter: 10 μm) | 100 parts |

-continued

| [Composition M] | |
|---|---|
| Heat-reactive aqueous urethane resin (Elastron MF-25, trade name, product of Dai-ichi Kogyo Seiyaku Co., Ltd.; solid content: 25%) | 400 parts |
| Organotin compound (Catalyst 64, trade name, product of Dai-ichi Kogyo Seiyaku Co., Ltd.) | 40 parts |
| Polyallylamine hydrochloride (PAA-HCl-10L, trade name, product of Nitto Boseki Co., Ltd.; solid content: 40%) | 23 parts |
| Benzalkonium chloride (G-50, trade name, product of Sanyo Chemical Industries, Ltd.; solid content: 50%) | 12 parts |

EXAMPLE 14

A releasing layer was provided on a base material composed of a polyethylene terephthalate film in the same manner as in Example 12. After a urethane emulsion (HYDRAN HW-930, trade name, product of Dainippon Ink & Chemicals, Incorporated; solid content: 50%) was coated on this releasing layer and dried at 100° C. for 3 minutes, the thus-dried film was further dried at 140° C. for 1 minute to obtain a uniform film layer. A transfer layer was further provided on the uniform film layer in the same manner as in Example 13.

[Printing and Evaluation]

Printing (mirror-image printing) was conducted on the thus-produced image-transfer media of Examples 10 to 14 (their compositions and film-forming conditions for the transfer layers being shown collectively in Table 3) in accordance with a back printing film mode by means of an ink-jet color printer, BJC-600J (trade name, manufactured by Canon Inc.). The respective transferred images formed on 100% cotton fabrics for T-shirt in the same manner as in Examples 1 to 4 and Comparative Example 1 after the printing were evaluated as to the following items in accordance with the following evaluation methods.

<Transferability (Image Density)>

The image density of each transferred image with the black print patch was measured in the same manner as in Examples 1 to 4 and Comparative Example 1 to evaluate the transferability. Similarly, the transferability of each sample was ranked as A where the image density was 1.2 or higher, B where the image density was lower than 1.2 but not lower than 1.0, or C where the image density was lower than 1.0. The evaluation results are shown in Table 4.

<Bleeding>

Bleeding at a boundary between two colors of each transferred image with the black and magenta print patches was visually observed in the same manner as in Examples 1 to 4 and Comparative Example 1 to evaluate the resistance to bleeding. Similarly, the resistance to bleeding of each sample was ranked as A where no bleeding occurred at the boundary between the two colors, or C where bleeding occurred at the boundary. The evaluation results are shown in Table 4.

<Fastness to Laundering>

The fastness to laundering of each transferred image with the black, cyan, magenta and yellow print patches was evaluated in the same manner as in Examples 1 to 4 and Comparative Example 1. The fastness to laundering of each sample was ranked as AA where the image was not deteriorated, A where only a part of the dyes exuded, B where the image density was lowered to a considerable extent, or C where the transfer layer was dissolved in the tepid water. The evaluation results are shown in Table 4.

TABLE 3

Composition of transfer layer (Examples 10 to 14)

| | Composition of transfer layer | Parts | Solid content | Ratio | Base material | Film forming condition |
|---|---|---|---|---|---|---|
| Ex. 10 | EVA emulsion (6 μm) | 250 | 100 | 10:1 | Paper for PPC coated with 20 μm vinyl fluoride resin | 60° C. 10 min Thickness: 40 μm |
| | Ionomer emulsion (smaller than 1 μm) | 28 | 9.8 | | | |
| Ex. 11 | EVA emulsion (6 μm) | 250 | 100 | 10:1 | Paper for PPC coated with 20 μm vinyl fluoride resin | 60° C. 10 min Thickness: 40 μm |
| | Ionomer emulsion (smaller than 1 μm) | 28 | 9.8 | | | |
| | Polyallylamine hydrochloride | 12 | 4.8 | | | |
| | Benzalkonium chloride | 6 | 3 | | | |
| Ex. 12 | Fine particles of nylon (10 μm) | 100 | 100 | 1:1 | PET film coated with 20 μm vinyl fluoride resin | Dried at 100° C. for 5 min, cured at 150° C. for 5 min Thickness: 40 μm |
| | Heat-reactive aqueous urethane resin | 400 | 100 | | | |
| | Organotin compound | 40 | | | | |
| Ex. 13 | Fine particles of nylon (10 μm) | 100 | 100 | 1:1 | PET film coated with 20 μm vinyl fluoride resin | Dried at 100° C. for 5 min, cured at 150° C. for 5 min Thickness: 40 μm |
| | Heat-reactive aqueous urethane resin | 400 | 100 | | | |
| | Organotin compound | 40 | | | | |
| | Polyallylamine hydrochloride | 23 | 9.2 | | | |
| | Benzalkonium chloride | 12 | 6 | | | |
| Ex. 14 | Fine particles of nylon (10 μm) | 100 | 100 | 1:1 | PET film coated with 20 μm vinyl fluoride resin and urethane | Dried at 100° C. for 5 min, cured at 140° C. for 5 min Thickness: 40 μm |
| | Heat-reactive aqueous urethane resin | 400 | 100 | | | |
| | Organotin compd. | 40 | | | | |
| | Polyallylamine hydrochloride | 23 | 9.2 | | | |
| | Benzalkonium chloride | 12 | 6 | | | |

The ratio in Table 3 was a value of (the fine particles of the thermoplastic resin/the water-insoluble resin).

TABLE 4

Evaluation results (Examples 1 to 14 and Comparative Example 1)

| | Transferability | Resistance to Bleeding | Fastness to laundering |
|---|---|---|---|
| Example 1 | A | A | A |
| Example 2 | A | A | A |
| Example 3 | A | A | A |
| Example 4 | A | A | A |
| Comparative Example 1 | C | — | — |
| Example 5 | A | A | A |
| Example 6 | A | A | AA |
| Example 7 | A | A | AA |
| Example 8 | A | A | AA |
| Example 9 | A | A | AA |
| Example 10 | A | A | A |
| Example 11 | A | A | AA |
| Example 12 | A | A | A |
| Example 13 | A | A | AA |
| Example 14 | A | A | AA |

EXAMPLE 15

A polyethylene terephthalate film having a thickness of 75 μm was used as a base material, and a vinyl monofluoride resin film having a thickness of 20 μm was laminated on this base material to provide a releasing layer. To this releasing layer, a coating formulation composed of Composition N containing fine particles of a thermoplastic resin, a water-soluble resin and finely particulate cellulose and having the following formulation was then applied by a bar coater process, so as to give a dry coating thickness of 40 μm. The thus-coated base material was dried at 60° C. for 10 minutes in a drying oven to provide a transfer layer, thereby producing an image-transfer medium.

| [Composition N] | |
|---|---|
| Ethylene-vinyl acetate emulsion (Chemipearl V-300, trade name, product of Mitsui Petrochemical Industries, Ltd.; particle diameter: 6 μm; solid content: 40%) | 100 parts |
| Polyvinyl alcohol (PVA-217, trade name, product of Kuraray Co., Ltd.; solid content: 20%) | 30 parts |

-continued

| [Composition N] | |
|---|---|
| Finely particulate cellulose (Ceorus Cream FP-03, trade name, product of Asahi Chemical Industry Co., Ltd.; particle diameter: 3.5 μm; solid content: 10%) | 100 parts |

EXAMPLE 16

A releasing layer was provided on a base material composed of a polyethylene terephthalate film in the same manner as in Example 15. On this releasing layer, a transfer layer was further provided in accordance with the same process as in Example 15 by using a coating formulation composed of Composition O containing fine particles of a thermoplastic resin, a water-soluble resin, finely particulate cellulose and cationic compounds and having the following formulation, thereby producing an image-transfer medium.

| [Composition O] | |
|---|---|
| Ethylene-vinyl acetate emulsion (Chemipearl V-300, trade name, product of Mitsui Petrochemical Industries, Ltd.; particle diameter: 6 μm; solid content: 40%) | 200 parts |
| Polyvinyl alcohol (PVA-217, trade name, product of Kuraray Co., Ltd.; solid content: 20%) | 40 parts |
| Finely particulate cellulose (Avicel PH-M06, trade name, product of Asahi Chemical Industry Co., Ltd.; particle diameter: 6 μm) | 4 parts |
| Polyallylamine hydrochloride (PAA-HCl-10L, trade name, product of Nitto Boseki Co., Ltd.; solid content: 40%) | 12 parts |
| Benzalkonium chloride (G-50, trade name, product of Sanyo Chemical Industries, Ltd.; solid content: 50%) | 6 parts |

EXAMPLE 17

A releasing layer was provided on a base material composed of a polyethylene terephthalate film in the same manner as in Example 15. To this releasing layer, a coating formulation composed of Composition P containing fine particles of a thermoplastic resin, a heat-reactive thermoplastic resin and finely particulate cellulose and having the following formulation was further applied by a bar coater process, so as to give a dry coating thickness of 40 μm. The thus-coated base material was dried at 100° C. for 5 minutes in a drying oven and then cured at 150° C. for 5 minutes to provide a transfer layer, thereby producing an image-transfer medium. The polymeric binder contained in the transfer layer formed in this example is a water-insoluble resin crosslinked by heat.

| [Composition P] | |
|---|---|
| Fine particles of nylon (Orgasol 3501, trade name, product of Nihon Rilsan KK; particle diameter: 10 μm) | 80 parts |
| Heat-reactive aqueous urethane resin (Elastron MF-25, trade name, product of Dai-ichi Kogyo Seiyaku Co., Ltd.; solid content: 25%) | 400 parts |

-continued

| [Composition P] | |
|---|---|
| Organotin compound (Catalyst 64, trade name, product of Dai-ichi Kogyo Seiyaku Co., Ltd.) | 40 parts |
| Finely particulate cellulose (PH-101, trade name, product of Asahi Chemical Industry Co., Ltd.; particle diameter: 20 μm) | 20 parts |

EXAMPLE 18

A releasing layer was provided on a base material composed of a polyethylene terephthalate film in the same manner as in Example 17. On this releasing layer, a transfer layer was further provided in accordance with the same process as in Example 17 by using a coating formulation composed of Composition Q containing fine particles of a thermoplastic resin, a heat-reactive thermoplastic resin, a crosslinking agent, cationic compounds and finely particulate cellulose and having the following formulation, thereby producing an image-transfer medium. The polymeric binder contained in the transfer layer formed in this example is a water-insoluble resin crosslinked by heat.

| [Composition Q] | |
|---|---|
| Fine particles of nylon (Orgasol 3501, trade name, product of Nihon Rilsan K.K.; particle diameter: 10 μm) | 80 parts |
| Heat-reactive aqueous urethane resin (Elastron MF-25, trade name, product of Dai-ichi Kogyo Seiyaku Co., Ltd.; solid content: 25%) | 400 parts |
| Organotin compound (Catalyst 64, trade name, product of Dai-ichi Kogyo Seiyaku Co., Ltd.) | 40 parts |
| Finely particulate cellulose (PH-101, trade name, product of Asahi Chemical Industry Co., Ltd.; particle diameter: 40 μm) | 20 parts |
| Polyallylamine hydrochloride (PAA-HCl-10L, trade name, product of Nitto Boseki Co., Ltd.; solid content: 40%) | 23 parts |
| Benzalkonium chloride (G-50, trade name, product of Sanyo Chemical Industries, Ltd.; solid content: 50%) | 12 parts |

[Printing and Evaluation]

Printing (mirror-image printing) was conducted on the thus-produced image-transfer media of Examples 15 to 18 (their compositions and film-forming conditions for the transfer layers being shown collectively in Table 5) in accordance with a back printing film mode by means of an ink-jet color printer, BJC-600J (trade name, manufactured by Canon Inc.). After the printing, each of the printed transferred media was placed on a 100% cotton fabric (a) for T-shirt and a 50:50 cotton/polyester blended fabric (b) for T-shirt with the transfer layer aligned with a portion of each fabric to be transferred. The transfer layer was transferred to the fabric by ironing from the base material side of the image-transfer medium. The temperature of an iron was controlled to a moderate temperature in each case to conduct the transfer for 20 seconds. The respective transferred images thus formed were evaluated as to the following item in accordance with the following evaluation method.

TABLE 5

Composition of transfer layer (Examples 15 to 18)

| | Composition of transfer layer | Parts | Solid content | Ratio | Base material | Film forming condition |
|---|---|---|---|---|---|---|
| Ex. 15 | EVA emulsion (6 μm) | 100 | 40 | 8.3:1 | PET film coated with 20 μm vinyl fluoride resin | 60° C. 10 min Thickness: 40 μm |
| | PVA | 30 | 6 | | | |
| | Finely particulate cellulose (3.5 μm) | 100 | 10 | | | |
| Ex. 16 | EVA emulsion (6 μm) | 200 | 80 | 10.5:1 | PET film coated with 20 μm vinyl fluoride resin | 60° C. 10 min Thickness: 40 μm |
| | PVA | 40 | 8 | | | |
| | Finely particulate cellulose (6 μm) | 4 | 4 | | | |
| | Polyallylamine hydrochloride | 12 | 4.8 | | | |
| | Benzalkonium chloride | 6 | 3 | | | |
| Ex. 17 | Fine particles of nylon (10 μm) | 80 | 80 | 1:1 | PET film coated with 20 μm vinyl fluoride resin | Dried at 100° C. for 5 min, cured at 150° C. for 5 min Thickness: 40 μm |
| | Heat-reactive aqueous urethane resin | 400 | 100 | | | |
| | Organotin compound | 40 | 40 | | | |
| | Finely particulate cellulose (6 μm) | 20 | 20 | | | |
| Ex. 18 | Fine particles of nylon (10 μm) | 80 | 80 | 1:1 | PET film coated with 20 μm vinyl fluoride resin | Dried at 100° C. for 5 min, cured at 150° C. for 5 min Thickness: 40 μm |
| | Heat-reactive aqueous urethane resin | 400 | 100 | | | |
| | Organotin compound | 40 | | | | |
| | Finely particulate cellulose (40 μm) | 20 | 20 | | | |
| | Polyallylamine hydrochloride | 23 | 9.2 | | | |
| | Benzalkonium chloride | 12 | 6 | | | |

The ratio in Table 5 was a value of (the fine particles of the thermoplastic resin+the finely particulate cellulose/the binder resin).

<Evaluation of Hand>

The transferred portions and the untransferred portions of the two kinds of fabrics on which the transferred image had been formed were visually observed and touched with hands to evaluate hand of the fabrics. Hand of each sample was ranked as A where there is little difference in hand between the transferred portion and the untransferred portion, AA where there is no substantial difference in hand between the transferred portion and the untransferred portion, or C where the transferred portion underwent a great change compared with the untransferred portion such as it became smooth and glossy, or irregularities are conspicuous and so it feels rough. The results are shown in Table 6.

TABLE 6

Evaluation results of hand (Examples 15 to 18)

| | Fabric (a) | Fabric (b) |
|---|---|---|
| Example 15 | AA | AA |
| Example 16 | A | A |
| Example 17 | AA | AA |
| Example 18 | AA | AA |

As apparent from Table 6, the image-transfer media of Examples 15 to 18, in which the finely particulate cellulose was contained in the transfer layer, provided fabrics for T-shirt having a clear print image without causing any difference in hand between the image formed portion and the non-image formed portion thereof.

EXAMPLE 19

Woodfree Paper coated with a silicone resin in advance was used as a base material, and a coating formulation having the following composition was melted under heat and then applied on the base so as to give a dry coating thickness of 3 to 4 μm. The thus-coated base was dried at 100° C. for 5 minutes to form a releasing layer, thereby producing a paper base material having the releasing layer.

| | |
|---|---|
| Alcohol-soluble nylon resin (Bestamelt 171, trade name, product of Daicel-Huels Ltd.) | 7 parts |
| Methanol | 93 parts |

To the releasing layer formed in the above-described manner, a coating formulation composed of Composition R containing fine particles of a thermoplastic resin, a water-soluble resin and a cationic substance and having the following formulation was further applied by a bar coater process, so as to give a dry coating thickness of 50 μm. The thus-coated base material was dried at 80° C. for 7 minutes in a drying oven to provide a transfer layer, thereby producing an image-transfer medium.

| [Composition R] | |
|---|---|
| Fine particles of nylon (Orgasol 3501, trade name, product of Nippon Phosphoric Acid Co., Ltd.; particle diameter: 10 μm) | 40 parts |
| Aqueous urethane emulsion (Takelac W-6354c, trade name, product of Takeda Chemical Industries, Ltd.; solid content: 35%) | 30 parts |
| Polyvinyl alcohol (PVA-217, trade name, product of Kuraray Co., Ltd.; solid content: 20 %) | 5 parts |
| Polyallylamine hydrochloride (PAA-HCl-10L, trade name, product of Nitto Boseki Co., Ltd.; solid content: 40%) | 5 parts |
| Water | 40 parts |

EXAMPLE 20

A paper base material obtained by providing the same releasing layer as that used in Example 19 on the same base as that used in Example 19 was used. To the releasing layer, a coating formulation composed of Composition S containing fine particles of a thermoplastic resin, a water-soluble resin, a water-insoluble resin, a crosslinking agent and a cationic substance and having the following formulation was applied in the same manner as in Example 19, so as to give a dry coating thickness of 40 μm to provide a transfer layer, thereby producing an image-transfer medium having the transfer layer.

| [Composition S] | |
|---|---|
| Fine particles of nylon (Orgasol 3501, trade name, product of Nihon Rilsan K.K.; particle diameter: 10 μm) | 30 parts |
| Fine particles of nylon (Bestamelt 430pl, trade name, product of Daicel-Huels Ltd.; particle diameter: 50 μm) | 10 parts |
| Aqueous urethane emulsion (Takelac W-6354c, trade name, product of Takeda Chemical Industries, Ltd.; solid content: 35%) | 30 parts |
| Heat-reactive aqueous urethane resin (Elastron MF-60, trade name, product of Dai-ichi Kogyo Seiyaku Co., Ltd.; solid content: 30%) | 5 parts |
| Organotin compound (Elastron Catalyst 64, trade name, product of Dai-ichi Kogyo Seiyaku Co., Ltd.) | 0.25 part |
| Alkaline cationic resin (EL Polymer NWS-16, trade name, product of Shin-Nakamura Chemical Co., Ltd.; solid content: 35%) | 5 parts |
| Water | 40 parts |

EXAMPLE 21

Woodfree Paper coated with a silicone resin in advance was used as a base material, and a behenic acid emulsion (Hitec E-8770, trade name, product of Toho Chemical Industry Co., Ltd.) was applied on the base so as to give a dry coating thickness of 20 μm. The thus-coated base was dried at 65° C. for 10 minutes to form a releasing layer, thereby producing a paper base material having the releasing layer.

To the releasing layer of the paper base material formed in the above-described manner, the same coating formulation as that used in Example 19 composed of Composition R was further applied by a bar coater process, so as to give a dry coating thickness of 50 μm. The thus-coated base material was dried at 60° C. for 10 minutes in a drying oven to provide a transfer layer, thereby producing an image-transfer medium.

EXAMPLE 22

Woodfree Paper coated with a silicone resin in advance was used as a base material, and a behenic acid emulsion (Hitec E-8770, trade name, product of Toho Chemical Industry Co., Ltd.) was coated on the base so as to give a dry coating thickness of 30 μm. The thus-coated base was dried at 65° C. for 10 minutes to form a releasing layer, thereby producing a paper base material having the releasing layer.

To the releasing layer of the paper base material formed in the above-described manner, the same coating formulation as that used in Example 20 composed of Composition S was further applied by a bar coater process, so as to give a dry coating thickness of 70 μm. The thus-coated base material was dried at 60° C. for 10 minutes in a drying oven to provide a transfer layer, thereby producing an image-transfer medium.

[Printing and Evaluation]

Printing (mirror-image printing) was conducted on the thus-produced image-transfer media of Examples 19 to 22 (their compositions and film-forming conditions for the transfer layers being shown collectively in Table 7) in accordance with a back printing film mode by means of an ink-jet color printer, BJC-600J (trade name, manufactured by Canon Inc.). After the printing, each of the printed transferred media was placed on a 100% cotton fabric for T-shirt with the transfer layer aligned with a portion of the fabric to be transferred. The transfer layer was transferred to the fabric by ironing from the base material side of the image-transfer medium. The temperature of an iron was controlled to a moderate temperature to conduct the transfer for 20 seconds. The respective transferred images thus formed were evaluated as to the following items in accordance with the following evaluation methods.

<Transferability (Image Density)>

The image density of the transferred image after transferred to the fabric for T-shirt using each of the image-transfer media obtained in Examples 19 to 22 was measured to evaluate the transferability. The measuring method was as follows. After an image was formed on each of the image-transfer media of Examples 19 to 22 in accordance with the above-described printing process, a transferred image with a black print patch of a 100% duty, in which dots were formed in the whole pixels, was formed on a fabric for T-shirt, whereby the image density of the image after the transfer was measured by means of a reflection densitometer, Macbeth RD-918 (trade name, manufactured by Macbeth Co.) to evaluate the transferability. The transferability of each sample was ranked as A where the image density was 1.2 or higher, B where the image density was lower than 1.2 but not lower than 1.0, or C where the image density was lower than 1.0. The evaluation results are shown in Table 8.

<Bleeding>

After an image was formed on each of the image-transfer media obtained in Examples 19 to 22 in accordance with the above-described printing process to form a transferred image with adjoiningly printed black and magenta print patches of 100% duty, in which dots were formed in the whole pixels, on a fabric for T-shirt, bleeding at a boundary between the two colors was visually observed. The resistance to bleeding of each sample was ranked as A where no bleeding occurred at the boundary between the two colors, or C where bleeding occurred at the boundary. The evaluation results are shown in Table 8.

<Fastness to Laundering>

Each of the image-transfer media obtained in Examples 19 to 22 was used to form an image on the image-transfer medium in accordance with the above-described printing process, thereby forming a transferred image with black, cyan, magenta and yellow print patches (each, about 15×15 mm) of 100% duty, in which dots were formed in the whole pixels, on a fabric for T-shirt. After the thus-obtained printed fabrics for T-shirt on which the transferred image with the black, cyan, magenta and yellow print patches had been formed were separately washed by hands for 2 minutes in tepid water of 30° C. and air dried, the transferred images were visually observed, thereby evaluating them as to the fastness to laundering. The fastness to laundering of each sample was ranked from the two points of view of "crocking" and "peeling" in accordance with the following standard.

First, "crocking" was ranked as AA where the image was not deteriorated, A where only a part of the dyes exuded, B where the image density was lowered to a considerable extent, or C where the transfer layer was dissolved in the tepid water. The evaluation results are shown in Table 8. Besides, "peeling" was ranked as AA where no peeling occurred, A where peeling was observed only at an edge part, B where peeling occurred in whole, or C where the transferred image was completely peeled off. The evaluation results are shown in Table 8.

TABLE 7

Composition of transfer layer (Examples 19 to 22)

| | Composition of transfer layer | Parts | Solid content | Ratio | Base material | Film forming condition |
|---|---|---|---|---|---|---|
| Ex. 19 | Fine particles of nylon (10 μm) | 40 | 40 | 3.5:1 | Woodfree paper coated with silicone resin and 3 to 4 μm nylon | 80° C. 7 min Thickness: 50 μm |
| | Aqueous urethane emulsion | 30 | 10.5 | | | |
| | PVC | 5 | 1 | | | |
| | Polyallylamine hydrochloride | 5 | 2 | | | |
| | water | 40 | | | | |
| Ex. 20 | Fine particles of nylon (10 μm) | 30 | 30 | 3.3:1 | Woodfree paper coated with silicone resin and 3 to 4 μm nylon | 80° C. 7 min Thickness: 40 μm |
| | Fine particles of nylon (50 μm) | 10 | 10 | | | |
| | Aqueous urethane emulsion | 30 | 10.5 | | | |
| | Heat-reactive aqueous urethane resin | 5 | 1.5 | | | |
| | Organotin compound | 0.25 | | | | |
| | Alkaline cation | 2 | 0.7 | | | |
| | Water | 40 | | | | |
| Ex. 21 | Fine particles of nylon (10 μm) | 40 | 40 | 3.5:1 | Woodfree paper coated with silicone resin and 20 μm behenic acid | 60° C. 10 min Thickness: 50 μm |
| | Aqueous urethane emulsion | 30 | 10.5 | | | |
| | PVC | 5 | 1 | | | |
| | Polyallylamine hydrochloride | 5 | 2 | | | |
| | water | 40 | | | | |
| Ex. 22 | Fine particles of nylon (10 μm) | 30 | 30 | 3.3:1 | Woodfree paper coated with silicone resin and 30 μm behenic acid | 60° C. 10 min Thickness: 70 μm |
| | Fine particles of nylon (50 μm) | 10 | 10 | | | |
| | Aqueous urethane emulsion | 30 | 10.5 | | | |
| | Heat-reactive aqueous urethane resin | 5 | 1.5 | | | |
| | Organotin compound | 0.25 | | | | |
| | Alkaline cation | 2 | 0.7 | | | |
| | Water | 40 | | | | |

The ratio in Table 7 was a value of (the fine particles of the thermoplastic resin/the polymeric binder).

TABLE 8

| Evaluation results (Examples. 19 to 22) | | | | |
|---|---|---|---|---|
| | Transfer ability | Resistance to Bleeding | Fastness to laundering | |
| | | | Crooking | Peeling |
| Example 19 | A | A | A | AA |
| Example 20 | A | A | AA | AA |
| Example 21 | A | A | A | AA |
| Example 22 | A | A | AA | AA |

According to the present invention, as described above, there can be provided image-transfer media which permit the simple formation of images on cloth by means of a general-purpose ink-jet printer. According to the present invention, in particular, high-density and clear images can be formed on the transfer layers of the image-transfer media with high ink absorbency by an ink-jet printing method. When such a transfer layer is transferred to cloth, a high-quality transferred image having high image density and excellent fastness properties such as fastness to laundering can be formed on the cloth because the transfer layer has good transferability to cloth so as to prevent a part of the image from being left on the releasing layer, and the transfer layer transferred to the cloth becomes excellent in strength and adhesion.

According to the present invention, there can be formed a transferred image, which is not different in feeling from a non-image formed portion, on cloth by further containing finely particulate cellulose in the transfer layer. Therefore, a cloth on which the transferred image has been formed can be provided with good hand as a whole.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image-transfer medium for ink-jet printing, comprising a releasing layer and a transfer layer containing particles of a thermoplastic resin and a polymeric binder, provided on a base material, wherein the polymeric binder is a thermoplastic resin and the transfer layer further contains particulate cellulose.

2. The image-transfer medium according to claim 1, wherein the particles of the thermoplastic resin have a particle diameter ranging from 0.05 to 100 $\mu$m.

3. The image-transfer medium according to claim 1, wherein the particles of the thermoplastic resin have a melting point ranging from 70 to 200° C.

4. The image-transfer medium according to claim 1, wherein the transfer layer has a film thickness ranging from 1 to 100 $\mu$m.

5. The image-transfer medium according to claim 1, wherein the particulate cellulose has a particle diameter ranging from 0.1 to 50 $\mu$m.

6. The image-transfer medium according to claim 1, wherein a mixing ratio by weight of the particles of the thermoplastic resin to the finely particulate cellulose falls within a range of from 1:1 to 50:1.

7. The image-transfer medium according to claim 1, wherein the transfer layer further contains a cationic substance.

8. The image-transfer medium according to claim 7, wherein the transfer layer further contains a plasticizer.

9. The image-transfer medium according to claim 1, wherein the particles of the thermoplastic resin are particles of nylon.

10. The image-transfer medium according to claim 1, wherein the polymeric binder is a water-insoluble thermoplastic resin.

11. The image-transfer medium according to claim 10, wherein a mixing ratio by weight of the particles of the thermoplastic resin to the water-insoluble thermoplastic resin falls within a range of from 1:2 to 50:1.

12. The image-transfer medium according to claim 11, wherein a mixing ratio by weight of the particles of the thermoplastic resin to the water-insoluble thermoplastic resin falls within a range of from 1:2 to 15:1.

13. The image-transfer medium according to claim 10, wherein a mixing ratio by weight of the sum of the particles of the thermoplastic resin and the particulate cellulose to the water-insoluble thermoplastic resin falls within a range of from 1:2 to 50:1.

14. An image-transfer printing process comprising ejecting inks on a transfer layer of an image-transfer medium for ink-jet printing, which has the transfer layer provided on a base material, in accordance with an ink-jet printing method to form an image, placing cloth on the image-transfer medium from the side of the transfer layer on which the image has been formed, and heating and pressing the transfer layer from the side of the cloth or the base material to transfer the transfer layer to the cloth, thereby forming an image on the cloth, wherein the image-transfer medium for ink-jet printing is the image-transfer medium for ink-jet printing according to any one of claims 1, 2, 3, 4, 11, 12, 5, 6, 13, 7, 8, 9 or 10.

15. A transfer-printing cloth having a transfer image formed by the image-transfer printing process according to claim 14.

* * * * *

UNITED STATES PATENT AND TRADEMARK OFFICE

CERTIFICATE OF CORRECTION

PATENT NO. : 6,495,241 B2
DATED : December 17, 2002
INVENTOR(S) : Sato et al.

It is certified that error appears in the above-identified patent and that said Letters Patent is hereby corrected as shown below:

Column 2,
Line 37, “more increase” should read -- increase more --; and
Line 61, “bleed” should read -- bleeding --.

Column 3,
Line 14, “after” should read -- after being --; and
Line 26, “resins” should read -- resin --.

Column 4,
Line 23, “after” should read -- after being --.

Column 9,
Line 62, “exhibites” should read -- exhibits --.

Column 19,
Line 61, “after” should read -- after being --.

Column 34,
Line 45, “Paper” should read -- paper --.

Column 35,
Line 60, “Paper” should read -- paper --.

Column 36,
Line 11, “Paper” should read -- paper --.

Column 37,
Line 16, “hands” should read -- hand --.

UNITED STATES PATENT AND TRADEMARK OFFICE

CERTIFICATE OF CORRECTION

PATENT NO. : 6,495,241 B2
DATED : December 17, 2002
INVENTOR(S) : Sato et al.

It is certified that error appears in the above-identified patent and that said Letters Patent is hereby corrected as shown below:

Column 39,
Table 8, line 9, "Transfer" should read -- Transfer- --; and
Table 8, line 10, "Crooking" should read -- Crocking --.

Column 40,
Line 9, "finely" should be deleted.
Line 49, "claims 1, 2, 3, 4, 11, 12, 5," should read -- claims 1 to 13. --; and
Line 50, "6, 13, 7, 8, 9 or 10." should be deleted.

Signed and Sealed this

Fourteenth Day of October, 2003

JAMES E. ROGAN
*Director of the United States Patent and Trademark Office*